US009605646B2

(12) United States Patent
Freen

(10) Patent No.: US 9,605,646 B2
(45) Date of Patent: Mar. 28, 2017

(54) IGNITING COMBUSTIBLE MIXTURES

(71) Applicant: BorgWarner, Inc., Auburn Hills, MI (US)

(72) Inventor: Paul Douglas Freen, Titusville, FL (US)

(73) Assignee: BorgWarner, Inc., Auburn Hills, MI (US)

( * ) Notice: Subject to any disclaimer, the term of this patent is extended or adjusted under 35 U.S.C. 154(b) by 219 days.

(21) Appl. No.: 14/257,748

(22) Filed: Apr. 21, 2014

(65) Prior Publication Data

US 2014/0226252 A1 Aug. 14, 2014

Related U.S. Application Data

(63) Continuation of application No. 13/054,523, filed as application No. PCT/US2009/051537 on Jul. 23, 2009, now Pat. No. 8,746,218.

(60) Provisional application No. 61/135,843, filed on Jul. 23, 2008, provisional application No. 61/210,278, filed on Mar. 16, 2009.

(51) Int. Cl.

| | |
|---|---|
| ***F02P 9/00*** | (2006.01) |
| ***F02P 17/12*** | (2006.01) |
| ***F02P 23/04*** | (2006.01) |
| *F02P 3/01* | (2006.01) |

(52) U.S. Cl.

CPC ..... *F02P 17/12* (2013.01); *F02P 23/04* (2013.01); *F02P 3/01* (2013.01); *F02P 9/007* (2013.01)

(58) Field of Classification Search

CPC . F02P 9/002; F02P 9/007; F02P 23/04; H01T 13/50; H01T 19/00; H01T 19/02; H01T 19/04

See application file for complete search history.

(56) References Cited

U.S. PATENT DOCUMENTS 4,231,331 A 11/1980 Suzuki et al.
5,361,737 A 11/1994 Smith et al.
(Continued)

FOREIGN PATENT DOCUMENTS

CN 1292926 A 4/2001
JP 2006513351 T 4/2006
(Continued)

OTHER PUBLICATIONS

Examination Report for Chinese Application No. 2009801353718, dated Nov. 5, 2012, 17 pages.
(Continued)

*Primary Examiner* — Erick Solis
(74) *Attorney, Agent, or Firm* — Fish & Richardson P.C.

(57) ABSTRACT

The disclosure relates methods and related systems for controlling corona discharge in a combustion chamber without causing an arc strike. The methods can include measuring a baseline impedance of a circuit in electrical communication with an electrode, measuring an actual impedance of the circuit, determining an impedance setpoint based at least in part on the baseline impedance, comparing the actual impedance to the impedance setpoint, and adjusting the actual impedance based at least in part on the comparison between the actual impedance and the impedance setpoint. The electrode is arranged to deliver a corona discharge to the combustion chamber.

26 Claims, 16 Drawing Sheets

(56) References Cited

U.S. PATENT DOCUMENTS

| | | | | |
|---|---|---|---|---|
| 6,883,507 | B2 | 4/2005 | Freen | |
| 7,392,795 | B2 | 7/2008 | Nagamine et al. | |
| 8,464,695 | B2 | 6/2013 | Ikeda | |
| 8,578,902 | B2 | 11/2013 | Permuy et al. | |
| 2004/0129241 | A1* | 7/2004 | Freen | F02C 7/266 123/143 B |

FOREIGN PATENT DOCUMENTS

| | | | |
|---|---|---|---|
| JP | 2006200388 | A | 8/2006 |
| JP | 2007113570 | A | 5/2007 |
| JP | 2007309160 | T | 11/2007 |
| JP | 2008121462 | A | 5/2008 |
| WO | WO2004063560 | A1 | 7/2004 |
| WO | WO2007017481 | A1 | 2/2007 |
| WO | WO2007144258 | A1 | 12/2007 |

OTHER PUBLICATIONS

Authorized Officer Athina Nickitas-Etienne, International Preliminary Report on Patentability for International Application No. PCT/US2009/051537, mailed Feb. 3, 2011, 6 pages.

Authorized Officer Gabriele Czakansky, International Search Report and Written Opinion for International Application No. PCT/US2009/051537, mailed Oct. 23, 2009, 11 pages.

Second Examination Report for Chinese Application No. 2009801353718, dated Jun. 20, 2013, 8 pages.

Third Examination Report for Chinese Application No. 2009801353718, dated Apr. 14, 2014, 8 pages.

Notice of Reasons for Rejection for Japanese Application No. 2011-520197, dated Apr. 2, 2013, 8 pages.

First Office Action for Chinese Application No. 201510146458.2, dated Apr. 27, 2016, 13 pages.

* cited by examiner

IGNITING COMBUSTIBLE MIXTURES

CROSS-REFERENCE TO RELATED APPLICATIONS

This application is a continuation application of U.S. patent application Ser. No. 13/054,523, filed on Jan. 17, 2011, which is the U.S. national stage under 35 USC §371 of International Application Number PCT/US2009/051537, filed on Jul. 23, 2009, which claims the benefit under 35 USC §119(e) of U.S. Provisional Patent Application Ser. No. 61/135,843, filed on Jul. 23, 2008, and U.S. Provisional Patent Application Ser. No. 61/210,278, filed on Mar. 16, 2009, the entire contents of which are hereby incorporated by reference.

TECHNICAL FIELD

The disclosure relates to using a corona electric discharge to ignite fuel-air mixtures, such as in internal combustion engines.

BACKGROUND

Many internal combustion engines ("ICEs") include a combustion chamber and a spark ignition system having two electrodes disposed in the combustion chamber and separated from one another by a relatively short gap. A high voltage DC electric potential is applied across the electrodes to cause dielectric breakdown in the gas between the electrodes. The dielectric breakdown results in an electric arc discharge that can initiate combustion of a fuel-air mixture in the vicinity of the electrodes in the combustion chamber. Under certain conditions, the ignited fuel-air mixture can form a flame kernel that can develop into a flame front. This flame front can then propagate from the vicinity of the electrodes and move across the combustion chamber.

The amount of electric potential used to produce an electric arc discharge between the electrodes can depend on several factors. For example, the minimum voltage potential required to produce an electric arc discharge can vary based on the spacing of the electrodes and/or the operating conditions of the ICE. As another example, the maximum voltage potential at the electrodes may be limited by the dielectric strength of the insulating materials in the spark ignition system.

SUMMARY

In general, in one aspect, a method of controlling a corona discharge in a combustion chamber without causing an arc strike includes measuring a baseline impedance of a circuit in electrical communication with an electrode, measuring an actual impedance of the circuit, determining an impedance setpoint based at least in part on the baseline impedance, comparing the actual impedance to the impedance setpoint, and adjusting the actual impedance based at least in part on the comparison between the actual impedance and the impedance setpoint. The electrode is arranged to deliver a corona discharge to the combustion chamber.

Implementations can include one or more of the following:

In some implementations, the method further includes determining an additional impedance, and determining an impedance setpoint includes adding the additional impedance to the baseline impedance.

In certain implementations, the additional impedance value is based at least in part on an optimal corona size in the combustion chamber.

In some implementations, the additional impedance value includes accessing a data structure and returning the stored additional impedance value associated with the operating state. The data structure associates an operating state with a stored additional impedance value correlated with a maximum corona size at the operating state without plasma creation and electric arc strike in the combustion chamber. The operating state can be one or more of the following: the size of the combustion chamber and a piston position in the combustion chamber.

In certain implementations, the method further includes detecting an electric arc strike in the combustion chamber, measuring a current operating state, determining a current additional impedance value, subtracting a first error margin from the current additional impedance value to provide an initial additional impedance value, and associating the current operating state with the initial additional impedance value in the data structure.

In some implementations, the method further includes operating the combustion chamber in various operating states during an initial period.

In certain implementations, determining a current additional impedance value further includes measuring a current actual impedance of the circuit that provides power to the electrode, measuring a current baseline impedance at an input to the circuit that provides power to the electrode, and subtracting the current baseline impedance from the current actual impedance to calculate the current additional impedance value.

In some implementations, the method further includes performing a periodic dithering process. The periodic dithering process includes increasing the returned impedance value associated with the operating state to create a modified additional impedance, adding the modified additional impedance value to the baseline impedance to calculate the setpoint impedance, determining if arc strike occurs in the combustion chamber. If no arc strike occurs, a current operating state is measured, a current additional impedance value is determined, and the current operating state is associated with the current additional impedance value in a data structure. If arc strike occurs, second error margin is subtracted from the modified additional impedance value to create a new modified additional impedance value, and the operating state is associated with the new modified additional impedance value in the data structure.

In certain implementations, adjusting actual impedance of the circuit includes increasing the actual impedance above the impedance setpoint to produce an arc discharge in the combustion chamber if the baseline impedance is above a value indicative of deposit buildup on the electrode and/or a portion of a feedthru insulator disposed between the electrode and the combustion chamber.

In some implementations, the method further includes sending an alert if the baseline impedance does not return below the value indicative of deposit buildup after the circuit has been operated at the increased actual impedance for a threshold period.

In certain implementations, the baseline impedance and the actual impedance are measured at an input to the circuit.

In general, in another aspect, a control system controls a corona discharge in a combustion chamber without causing an arc strike. The control system includes an electrode arranged to deliver a corona discharge to the combustion chamber, a circuit in electrical communication with the electrode, and a system controller. The system controller is configured to measure a baseline impedance of the circuit, determine an impedance setpoint based at least in part on the baseline impedance, measure an actual impedance of the circuit, compare the actual impedance to the impedance setpoint, and to adjust the actual impedance based at least in part on the comparison between the actual impedance and the impedance setpoint so as to control the corona discharge.

In some implementations, the system controller is further configured to determine an additional impedance and add the additional impedance to the baseline impedance to determine the impedance setpoint. The system controller can be configured to determine the additional impedance value based at least in part on an optimal corona size in the combustion chamber.

In certain implementations, the system controller is configured to access a data structure associating an operating state with a stored additional impedance value and to return the stored additional impedance value associated with the operating state. The stored additional impedance value is correlated with a maximum corona size at the operating state without plasma creation and electric arc strike in the combustion chamber. The operating state can be the size of the combustion chamber and/or piston position in the combustion chamber.

In some implementations, the system controller is further configured to detect an electric arc strike in the combustion chamber, measure a current operating state, determine a current additional impedance value, subtract a first error margin from the current additional impedance value to provide an initial additional impedance value, and associate the current operating state with the initial additional impedance value in the data structure. The system controller can be further configured to operate the combustion chamber in various operating states during an initial period.

In certain implementations, the configuration of the system controller to determine the additional impedance value further includes configuration of the system controller to measure a current actual impedance of the circuit that provides power to the electrode, measure a current baseline impedance at an input to the circuit that provides power to the electrode, and subtract the current baseline impedance from the current actual impedance to calculate the current additional impedance value.

In some implementations, the system controller is further configured to perform a periodic dithering process. The configuration of the system controller to perform the dithering process includes configuration of the system controller to increase the returned impedance value associated with the operating state to create a modified additional impedance, add the modified additional impedance value to the baseline impedance to calculate the setpoint impedance, and determine if arc strike occurs in the combustion chamber. If no arc strike occurs, the system controller is configured to measure a current operating state, determine a current additional impedance value, and associate the current operating state with the current additional impedance value in a data structure. If arc strike occurs, the system controller is configured to subtract a second error margin from the modified additional impedance value to create a new modified additional impedance value, and associate the operating state with the new modified additional impedance value in the data structure.

In certain implementations, the system controller is configured to increase the actual impedance above the impedance setpoint to produce an arc discharge in the combustion chamber if the baseline impedance is above a value indicative of deposit buildup on the electrode and/or a feedthru insulator disposed between the electrode and the combustion chamber.

In some implementations, the system controller is further configured to send an alert if the baseline impedance does not return below the value indicative of deposit buildup after the circuit has been operated at the increased actual impedance for a threshold period.

In certain implementations, the baseline impedance and the actual impedance are measured at an input to the circuit.

In general, in another aspect, a method of controlling electric discharge energy to reduce deposits on a corona discharge ignition system includes measuring a baseline impedance of a circuit in electrical communication with an electrode, measuring an actual impedance of the circuit, determining an impedance setpoint based at least in part on the baseline impedance, comparing the actual impedance to the impedance setpoint, and increasing the actual impedance above the impedance setpoint to produce an arc discharge in the combustion chamber if the baseline impedance is above a value indicative of deposit buildup on the electrode and/or a portion of a feedthru insulator disposed between the electrode and the combustion chamber. The electrode is arranged to deliver a corona discharge to the combustion chamber.

In some implementations, the method further includes sending an alert to a master engine controller if the baseline impedance does not return below the value indicative of deposit buildup after the circuit has been operated at the increased actual impedance for a threshold period.

In certain implementations, increasing the actual impedance includes increasing the actual impedance above the impedance setpoint for a fixed period of time.

In general, in another aspect, a computer program product residing on a computer readable medium for controlling a corona discharge in a combustion chamber without causing an arc strike includes instructions for causing a computer to measure a baseline impedance of the circuit, measure an actual impedance of the circuit, determine an impedance setpoint based at least in part on the baseline impedance, compare the actual impedance to the impedance setpoint, and adjust the actual impedance based at least in part on the comparison between the actual impedance and the impedance setpoint.

Other aspects, features, and advantages will be apparent from the description and drawings, and from the claims.

DETAILED DESCRIPTION

Figure 1:
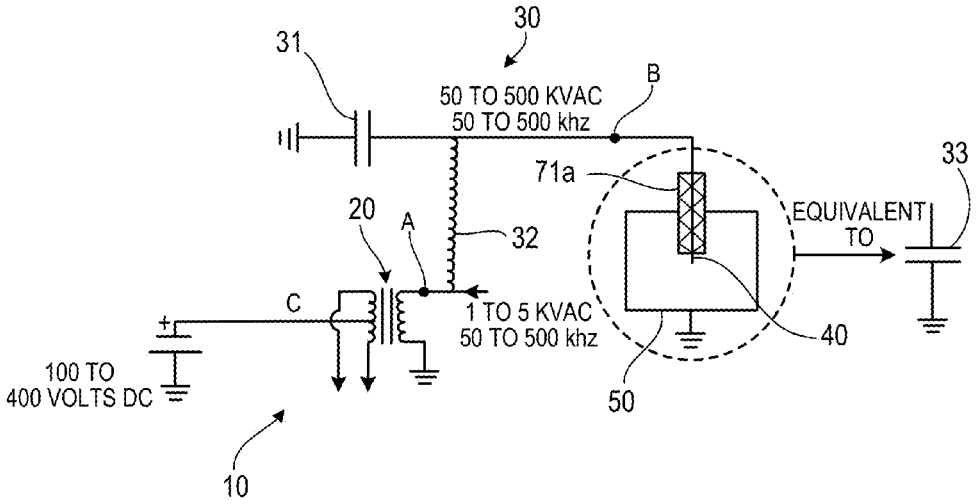
FIG. 1 is a schematic diagram of a corona discharge ignition system with the electrode directly coupled to the combustion chamber.

Referring to FIG. 1, a corona discharge ignition system initiates combustion of a fuel/air mixture in an internal combustion engine (ICE) as described, for example, in U.S. provisional patent application 61/135,843 by Freen, filed on Jul. 23, 2008, U.S. provisional patent application 61/210,278 by Freen, filed on Mar. 16, 2009, and U.S. Pat. No. 6,883,507, all of which are incorporated herein by reference in their entireties. For clarity of explanation, operation of the corona discharge ignition system is described below with respect to a reciprocating ICE. However, it should be noted that the corona discharge ignition system can be used to ignite fuel/air mixtures in other types of engines such as, for example, gas turbine engines.

The corona discharge system includes a low voltage circuit 10 coupled across a radio frequency step-up transformer 20 to a high voltage circuit 30, which is in turn coupled to an electrode 40. During use, the electrode 40 is charged to a high, radio frequency ("RF") voltage potential to create a strong RF electric field in the combustion chamber 50. The strong electric field causes a portion of the fuel-air mixture in the combustion chamber to ionize. However, as described below, the electric field can be controlled (e.g., by controlling the discharge electrode voltage to achieve an impedance setpoint of the high voltage circuit 30) such that dielectric breakdown of the gas in the combustion chamber 50 does not proceed to the level of an electron avalanche which would result in formation of a plasma and an electric arc being struck from the electrode 40 to the grounded walls of the combustion chamber 50 (e.g., cylinder walls and/or piston head). Rather, by controlling the impedance of the high voltage circuit 30, the electric field is maintained at a level where only a portion of the fuel-air gas is ionized—a portion insufficient to create the electron avalanche chain which results in a plasma and arc strike. However, electric field is maintained sufficiently strong to allow a corona discharge to occur. In a corona discharge, some electric charge on the electrode 40 is dissipated through being carried through the gas to the ground as a small electric current, or through electrons being released from or absorbed into the electrodes from the ionized fuel-air mixture, but the current is very small and the voltage potential at the electrode 40 remains very high in comparison to an arc discharge. The sufficiently strong electric field causes ionization of a portion of the fuel-air mixture to initiate combustion of a fuel-air mixture in the combustion chamber 50.

The low voltage circuit 10 may be a 100 to 400V DC circuit, for example. The 100 to 400V electric potential can be conventionally produced using one or more step-up transformers connected to a power system such as, for example, a 12V, 24V, or 48V DC power system of an engine. The voltage and/or current of the low voltage circuit 10 can be controlled by a control system, as described in further detail below. The low voltage circuit 10 feeds an RF step-up transformer 20 which can have an output of 1 to 5 KVAC at 50 to 500 kHz, for example.

The RF step-up transformer 20 drives a high voltage circuit 30. The high voltage circuit 30 may include one or more inductive elements 32, for example. The inductive element 32 may have an associated capacitance, which is represented as element 31 in FIG. 1. In addition, the wiring, electrode 40, feedthru insulator 71*a* and ground may have an associated capacitance, which is illustrated as element 33 in FIG. 1. Together, the inductive element 32, the capacitance 31, and the capacitance 33 form a series LC circuit having an associated resonant frequency.

The high voltage circuit 30 includes a 7.5 millihenry inductor 32 and an equivalent series capacitance (31 and 33) of 26 picofarads. The resonant frequency for this embodiment is 360 kilohertz. The output frequency of the RF step-up transformer 20 is matched to the resonant frequency of the high voltage circuit 30. Thus, when the RF step-up transformer 20, with an output of 1 to 5 KVAC for example, drives the high voltage circuit 30 at its resonant frequency, the high voltage circuit becomes excited, resulting in a substantial increase in the voltage potential, e.g., to 50 to 500 KVAC, at the output (point B) of the high voltage circuit 30.

The capacitive elements 31, 33 and the inductive element 32 illustrated in FIG. 1 are representative of possible architectures. Other architectures could be used for producing high voltages in the radio frequency range. Similarly, the voltages and frequencies of the low voltage circuit 10 and the high voltage circuit 30 stated above are merely exemplary. In general, voltages, frequencies, component arrangements of the low voltage circuit 10 and the high voltage circuit 30 may be chosen according to the requirements of the particular ignition system application. Typically, the frequency of the RF power supplied to the electrode 40 will be between 30,000 and 3,000,000 hertz.

The output of the high voltage circuit 30 is connected to the electrode 40. The electrode 40 is positioned such that charging the high voltage circuit 30 results in the formation of an electric field in the volume defined by the combustion chamber 50 (e.g., between the electrode 40 and the walls of the combustion chamber 50). For example, the electrode 40 can be arranged such that at least a portion of the electrode 40 projects into the volume defined by the combustion chamber 50.

The walls of the combustion chamber 50 are grounded with respect to the electrode 40. The combustion chamber 50 and the electrode 40 form the equivalent of two plates of a conventional capacitor separated by the dielectrics of the feedthru insulator 71*a* and the gaseous fuel-air mixture present in the combustion chamber 50 during operation. This capacitance stores electric field energy and is illustrated in FIG. 1 by the circle around the electrode 40 and the combustion chamber 50 in the high voltage circuit 30.

The electrode 40 extends through the feedthru insulator 71*a* such that at least a portion of the electrode 40 is disposed directly in the volume defined by the combustion chamber 50. This arrangement of the electrode 40 can facilitate direct exposure of the electrode 40 to a fuel-air mixture in the combustion chamber 50. Such direct exposure of the electrode 40 to the volume defined by the combustion chamber 50 can facilitate efficient production of a strong electric field.

Figure 2:
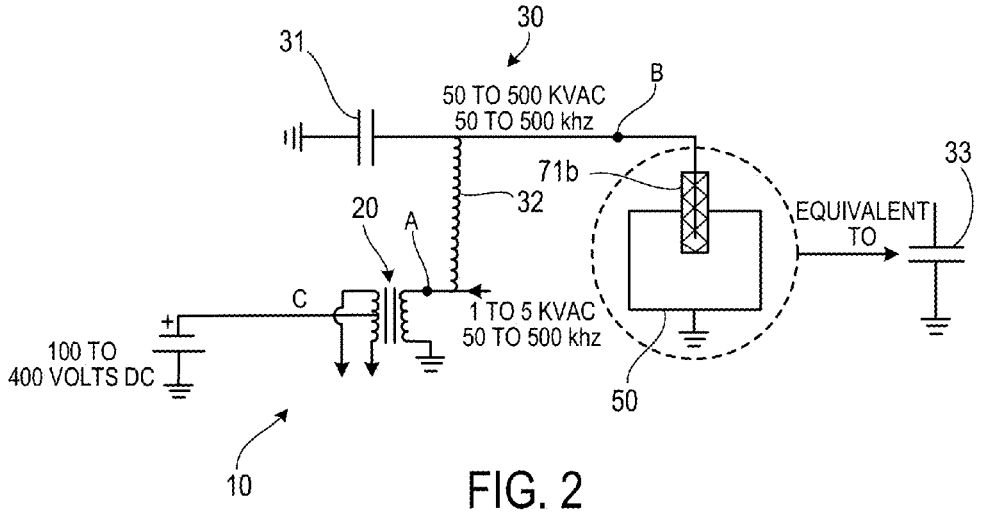
FIG. 2 is a schematic diagram of a corona discharge ignition system with the electrode capacitively coupled to the combustion chamber.

As shown in FIG. 2, in some embodiments, the electrode 40 is shrouded by the dielectric material of the feedthru insulator 71*b* such that the electrode is not directly exposed to the fuel-air mixture. During use, the electric field of the electrode 40 passes through part of the feedthru insulator 71*b* and into the volume defined by the combustion chamber 50. In other respects, the capacitively coupled system in FIG. 2 can be the same as the system of FIGS. 1 and 3. Because the electrode 40 is not directly exposed to the combustion chamber, the electrode 40 is protected from the harsh environment of the combustion chamber 50. Such protection of the electrode 40 can, for example, reduce the deterioration rate of the electrode 40.

Figure 3:
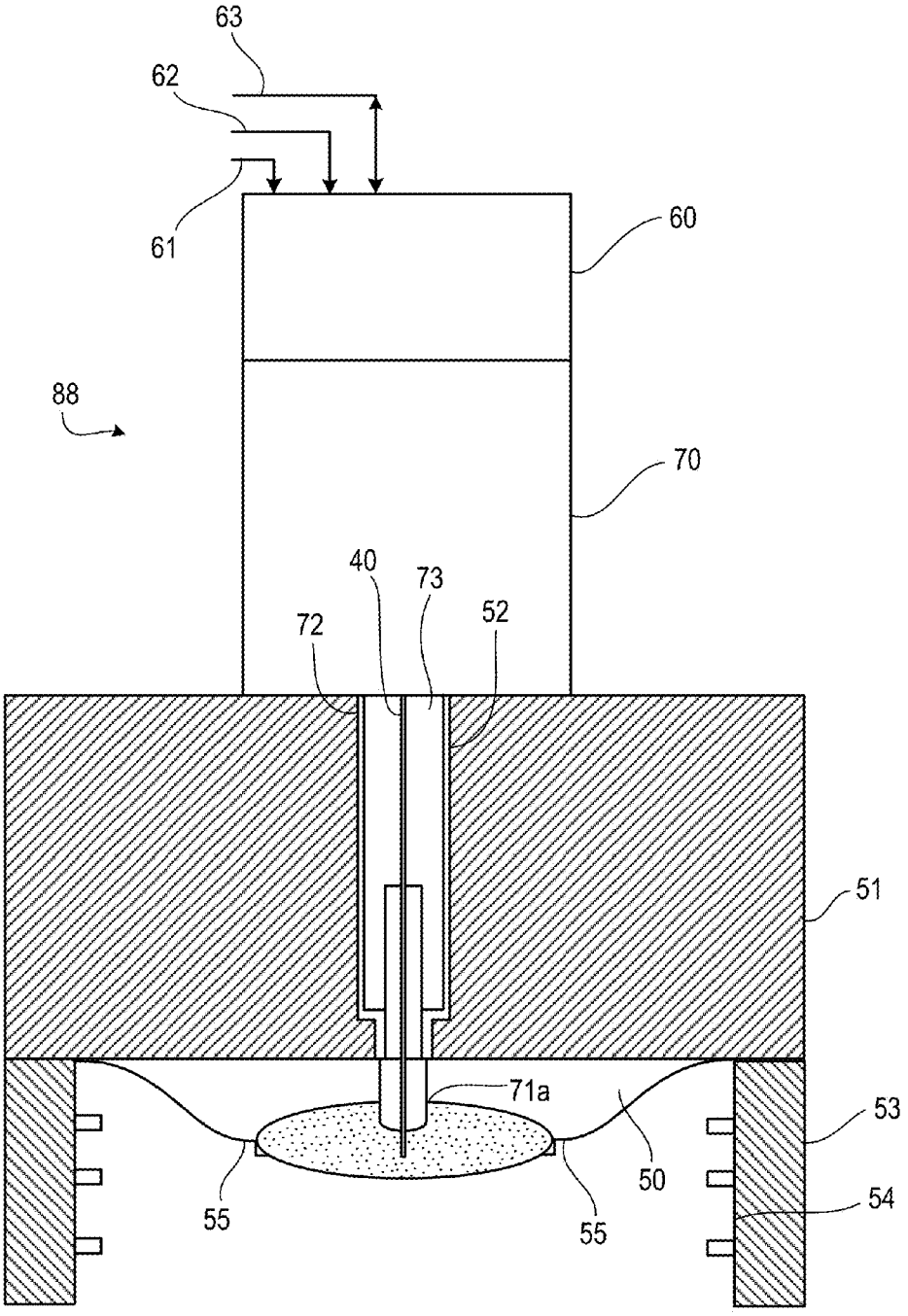
FIG. 3 is a schematic diagram of the components of the corona discharge combustion system of FIG. 1 situated in a reciprocating internal combustion engine.

FIG. 3 is a schematic, sectional view of a corona discharge ignition system with components packaged together in a relatively small volume and attached to an ICE. The corona discharge ignition system may work well with existing reciprocating ICEs with little modification of the basic structure of the engine. For example, the electrode 40 and feedthru insulator 71*a* (or feedthru insulator 71*b*) can be sized to fit through a spark plug socket and into a combustion chamber of a typical spark-ignited reciprocating ICE.

In the embodiment in FIG. 3, a control electronics and primary coil unit 60 receives as inputs a timing signal 61, a low voltage DC power source 62, e.g. 150 volts DC, and control information 63. An output of the control electronics and primary coil unit 60 may be diagnostic information 63 about the performance of the corona discharge ignition system. The RF step-up transformer 20 of FIG. 1 is included in the control electronics and primary coil unit 60. A secondary coil unit 70 is adjacent the control electronics and primary coil unit 60 and the cylinder head 51 of the engine. The capacitive and inductive element(s) 31 and 32 of the high voltage circuit 30 of FIG. 1 are part of the secondary coil unit 70 of FIG. 3. The control electronics and primary coil unit 60 are located close to the secondary coil unit 70. In some embodiments, however, the control electronics and primary coil unit 60 may be remotely mounted and the output of the RF step-up transformer may be connected to the input of the secondary coil via, for example, a coax cable.

The feedthru insulator 71*a* surrounds the electrode 40 extending through the cylinder head 51 into the combustion chamber 50. The cylinder head 51, cylinder walls 53, and piston 54 are grounded with respect to the electrode 40. The feedthru insulator 71*a* is fixed in an electrode housing 72 which may be a metal cylinder, for example. The feedthru insulator 71*a* may be formed of boron nitride, for example. The space 73 between the electrode housing 72 and the electrode 40 may be filled with a dielectric gas such as, for example, sulfur hexafluoride (SF.sub.6), compressed air, and/or compressed nitrogen. Additionally or alternatively, the space 73 between the electrode housing 72 and the electrode 40 may be filled with a dielectric fluid and/or a dielectric solid (e.g., aluminum oxide and boron nitride).

The control electronics and primary coil unit 60, secondary coil unit 70, electrode housing 72, electrode 40 and feedthru insulator 71*a* together form an ignitor 88 which may be inserted into a space 52 defined by the cylinder head 51. For example, the smaller diameter portion of the electrode housing 72 may have threads that cooperate with corresponding threads in the cylinder head 51 such that the ignitor 88 can be secured in place by being screwed into the cylinder head 51.

Figure 4:
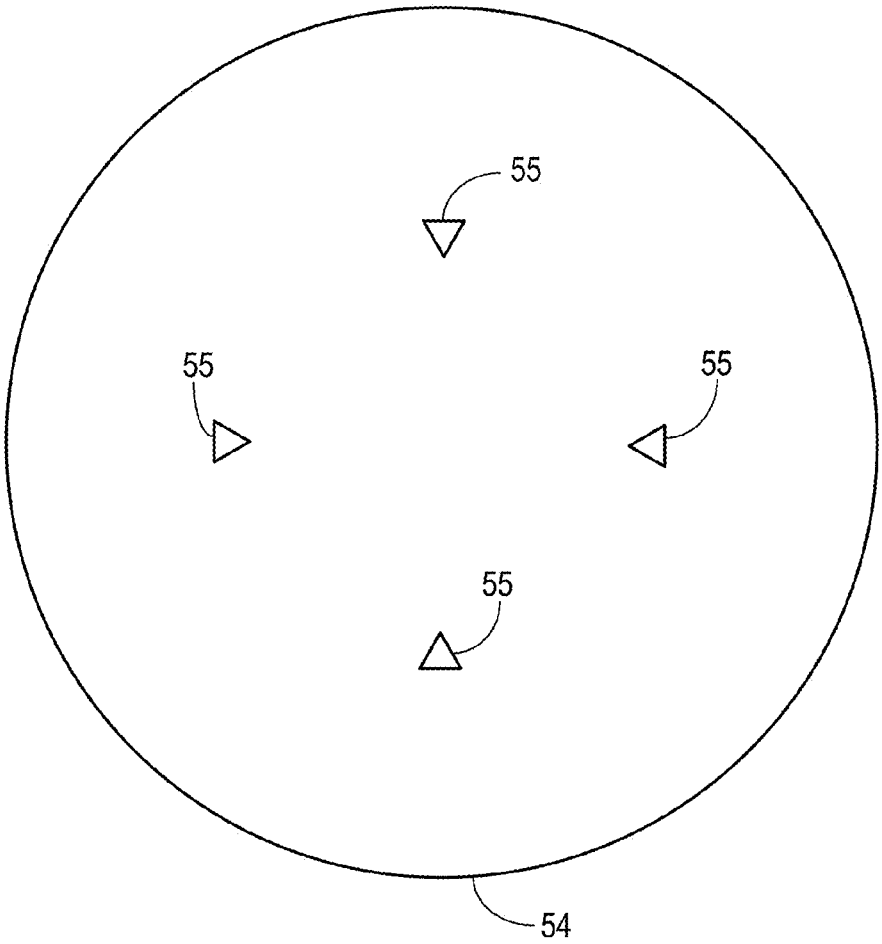
FIG. 4 is a diagram of field intensifiers distributed on the head of a piston of the reciprocating internal combustion engine in FIG. 3.

Referring to FIG. 4, in some embodiments, the combustion chamber 50 is configured to focus the area of greatest electric field strength. Field intensifiers 55 include relatively sharp protrusions that extend from the head of the piston 54 toward the cylinder head 51. During operation, the field intensifiers 55 focus the electric field into an area between the field intensifiers 55 and the electrode 40 (e.g., the shaded area in FIG. 3). In some embodiments, field intensifiers 55 can be formed of the relatively sharp edges of a bowl defined in the piston. In certain embodiments, a number of protrusions extend from the electrode 40 to focus the area of greatest electric field strength (e.g., between the electrode 40 and the grounded combustion chamber 50). For example, the electrode 40 may include four protrusions extending radially outwardly from the electrode 40 toward the walls of the combustion chamber 50.

Because the electric field is spread out across a relatively large volume in the combustion chamber 50 (even when the field is somewhat focused, e.g., as depicted in FIG. 3), the resultant flame front produced by the corona discharge ignition system is larger than a flame kernel typical of combustion initiated by a spark-ignition system. This larger flame front can facilitate combusting overall lean fuel-air mixtures. For example, due to turbulence and/or other factors, an overall lean fuel-air mixture may have a heterogeneous distribution of fuel in the combustion chamber 50 such that some local fuel-air ratios are leaner than the overall ratio and some local fuel-air ratios are richer than the overall ratio. As compared to the smaller flame kernel typically produced by a spark-ignition system, the larger flame front produced by the corona discharge ignition system can improve, for example, ignition in portions of the combustion chamber 50 with local fuel-air ratios that are leaner than the overall ratio.

A control system may be provided to control the low voltage circuit 10, for example, so that the corona discharge ignition system fires at the correct time during the engine cycle and so that the electric discharge does not cause complete dielectric breakdown that can result in formation of a plasma and an electric arc in the combustion chamber 50. The control system can fire the ignition system at a predetermined time (e.g., 10 crank angle degrees (CAD) before top dead center) and maintain the corona for a predetermined duration (e.g., 1 to 2 milliseconds) during each ignition cycle. Additionally or alternatively, the duration for maintaining the corona discharge can be a function of engine operating conditions (e.g., engine speed, load, exhaust gas recirculation (EGR) concentration).

The energy provided by the corona discharge in each ignition cycle is sufficient to ignite the fuel-air mixture in the combustion chamber. Extending corona duration to 1-2 milliseconds or longer can extend the lean limit and EGR limit of an engine. For example, extending the corona duration from 1 millisecond to 1.5 milliseconds can extend the lean misfire limit from lambda=1.45 to lambda=1.7 (more than 15%). By extending the lean limit of an engine, the corona discharge ignition system can lower engine-out nitric oxide emissions and/or lower fuel consumption.

Additionally or alternatively, the control system may include the ability to select dynamically the time at which the corona discharge ignition system will fire during the ignition cycle, the duration of the firing, and also the number of firings per ignition cycle. Such dynamic control can be used to optimize power output, emissions, and/or thermal efficiency of an ICE. The corona discharge ignition system may provide better opportunities to control the combustion of the fuel-air mixture and, therefore, may provide improved power output, emissions, and/or thermal efficiency of an ICE with respect to an ICE with a spark ignition system. With the corona discharge ignition system, the possible range of control may be significantly greater because of the ability to introduce ionizing energy into the combustion chamber 50 at a rate which may be significantly higher than a conventional spark ignition system, and because of the ability to introduce a much greater total amount of ionizing energy into the combustion chamber 50 (e.g., per power stroke of a reciprocating ICE).

Additionally or alternatively, the control system may monitor operational conditions (e.g., detect misfire) in the combustion chamber 50 to facilitate further control. In some implementations, the control system may be configured to take advantage of unique aspects of the sustained corona discharge system to monitor operational conditions, as is discussed in greater detail below.

Figure 5:
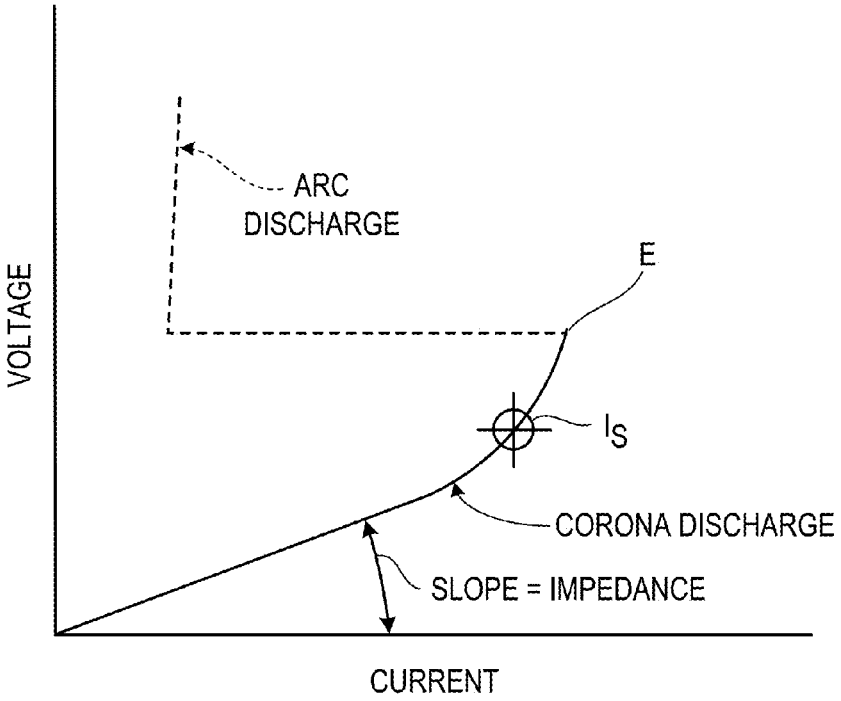
FIG. 5 is a graph of hypothetical, idealized input characteristics at point A of the high voltage circuit of the corona discharge ignition system of FIG. 1.
Figure 6:
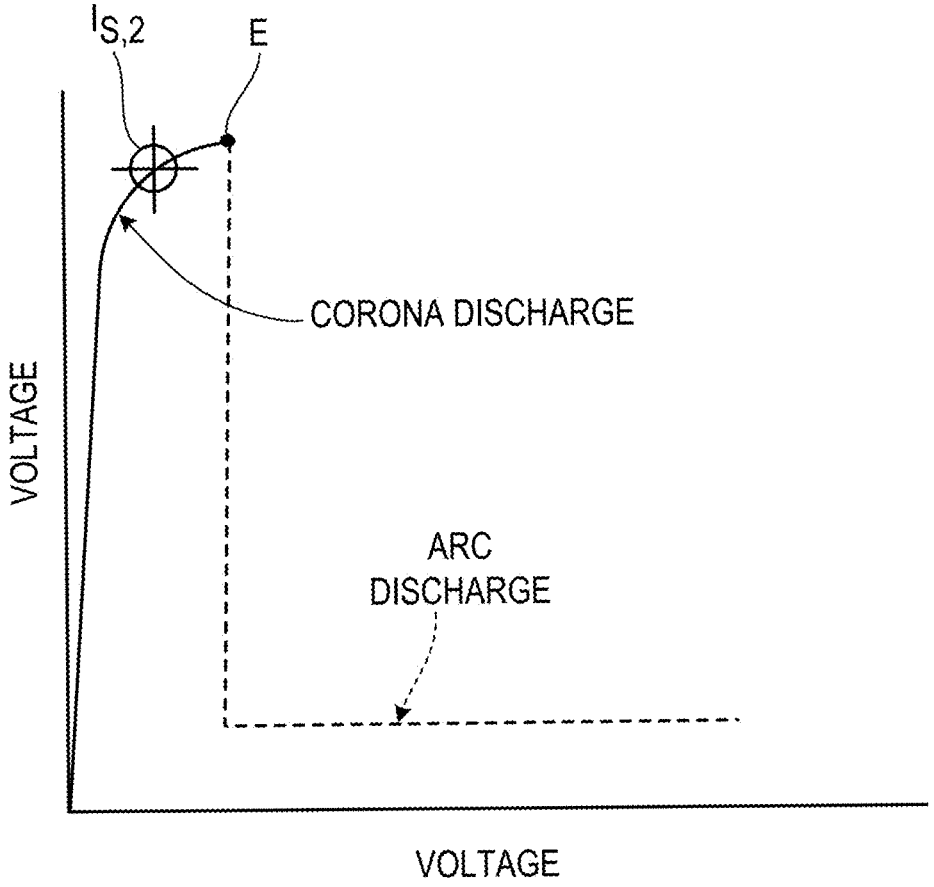
FIG. 6 is a graph of hypothetical, idealized output characteristics at point B of the high voltage circuit of the corona discharge ignition system of FIG. 1.

Referring to FIGS. 5 and 6, the corona discharge ignition system is controlled to avoid an electron avalanche that results in plasma and an arc discharge. FIG. 5 illustrates hypothetical, idealized input characteristics of the high voltage circuit 30 at point A in FIG. 1. FIG. 6 illustrates hypothetical, idealized output characteristics of the high voltage circuit 30 to the electrode 40 at point B in FIG. 1. FIG. 6 is also a useful illustration of the difference between the characteristics of a corona electric discharge and an arc electric discharge. Beginning at the origin of the voltage and current graph of FIG. 6, as the voltage potential at the electrode 40 increases, the current increases at a comparatively slow rate. This is due to the dielectric properties of the fuel-air gas. As the voltage is further increased to a relatively high voltage potential, the rate of the current rise increases. This is evident from the decrease in the slope of the voltage-current trace. This indicates that dielectric breakdown of the gaseous fuel-air mixture has begun and corona discharge is occurring in this transition stage. If the voltage is increased even further, past this transition stage, the gaseous fuel-air mixture undergoes complete dielectric breakdown (approximately at E in the graph of FIG. 6) and a plasma is formed in the fuel-air gas. Plasma can carry charge easily, so while plasma is sustained in the combustion chamber 50 the voltage potential is greatly reduced and the current passes relatively freely through an electric arc. The corona discharge ignition system is controlled so that the output of the high voltage circuit 30 generally does not extend into the dotted line region shown in FIG. 6 and, thus, generally does not produce an electron avalanche that results in the formation of plasma and an electric arc. As discussed below, however, certain methods of controlling the corona discharge ignition system require and/or allow operation of the system in an arc striking mode for brief periods (e.g., to establish an impedance setpoint).

The input characteristics of the high voltage circuit 30 shown in FIG. 5 are nearly the opposite of the output characteristics shown in FIG. 6. As the electric potential of the electrode 40 increases (before an arc is struck) and the output voltage rises as shown in FIG. 5, the input current increases as shown in FIG. 6 to produce the high output voltage. The voltage at the input rises as the input current rises. The voltage divided by the current represents the impedance, and the impedance is nearly constant for low voltages. In the transition stage at which the corona discharge occurs, the voltage rises more quickly than the current and the impedance increases, as represented by the increased slope below point "C" in FIG. 5. If an arc were to be struck at the electrode 40, the input current would drop dramatically, as indicated by the horizontal portion of the dotted line in FIG. 5. The corona discharge ignition system is controlled so that the input to the high voltage circuit 30 generally does not extend into the dotted line region shown in FIG. 5 and, thus, generally does not produce an electron avalanche that results in the formation of plasma and an electric arc. As discussed below, however, certain methods of controlling the corona discharge ignition system require and/or allow operation of the system in an arc striking mode for brief periods (e.g., to establish an impedance setpoint).

Impedance of the high voltage circuit 30 is used to regulate the electric discharge such that a corona-type electric discharge is generally generated and sustained. The relationship between impedance and resulting characteristics of the electric discharge of the high voltage circuit 30 is substantially independent of pressure in the combustion chamber 50. Thus, the use of impedance as the control variable of the corona discharge ignition system can, for example, simplify control methods used to generate and sustain the corona-type electric discharge.

An impedance setpoint $I_s$ (see FIG. 5) of the input to the high voltage circuit 30 can be selected and/or empirically determined. Variation of the impedance setpoint can be used to vary the character of the electric discharge in the combustion chamber 50. For example, below the level at which arc discharge occurs, a higher impedance setpoint will result in greater ionization power and a larger corona size.

In some embodiments, the impedance setpoint $I_s$ is varied to control the characteristics of the corona-electric discharge generated by the corona discharge ignition system. In some embodiments, the actual impedance $I_a$ can be measured and compared with impedance setpoint $I_s$. The power input for the low voltage circuit 10 can then be regulated using pulse width modulation, for example, to cause the actual impedance $I_a$ to be at or near the impedance setpoint $I_s$.

As is discussed below with reference to FIG. 7A, in some embodiments, the impedance setpoint $I_s$ is determined by separating the setpoint impedance into a baseline impedance and an additional impedance value.

The baseline impedance may be directly measured and can serve as a quantifiable reference impedance of the system. For example, an increase in the baseline impedance over time can be indicative of deposit buildup (e.g., carbon buildup) on the electrode 40 and/or a portion of the feedthru insulator 71*a*, 71*b* disposed between the electrode 40 and the combustion chamber 50. In some embodiments, the system controller 84 can set the impedance setpoint to a level sufficient for arc generation between the electrode 40 and the combustion chamber 50. The arc can act to remove at least a portion of the deposit buildup. The arc generating mode can be sustained for a fixed period of time and/or until the measured baseline impedance returns to an acceptable level (e.g., a level indicative of a substantially clean electrode 40).

The additional impedance value relates to the size of the corona formed. This additional value and, thus, the size of the corona formed can depend upon operating states of the corona discharge ignition system and/or the ICE. For example, the additional impedance can depend on the size (e.g., volume) of the combustion chamber 50. Since the size of the combustion chamber 50 can change during the operating cycle of the ICE (e.g., such as when the piston head approaches top dead center during a compression stroke), the additional impedance for calculating the impedance setpoint can change as the volume of the combustion chamber 50 changes with each crank angle degree. In some embodiments, the additional impedance for calculating the impedance setpoint is specified as a mathematical function of the crank angle of a reciprocating ICE. In certain embodiments, the additional impedance value for a desired corona size or other corona characteristic (e.g., intensity, power) is mapped to each operating state of the engine in a data structure for subsequent retrieval and use in calculating the setpoint impedance. Parameters that used to map the additional impedance in the data structure can include engine speed, engine load, EGR rate, and coolant temperature.

Figure 7A:
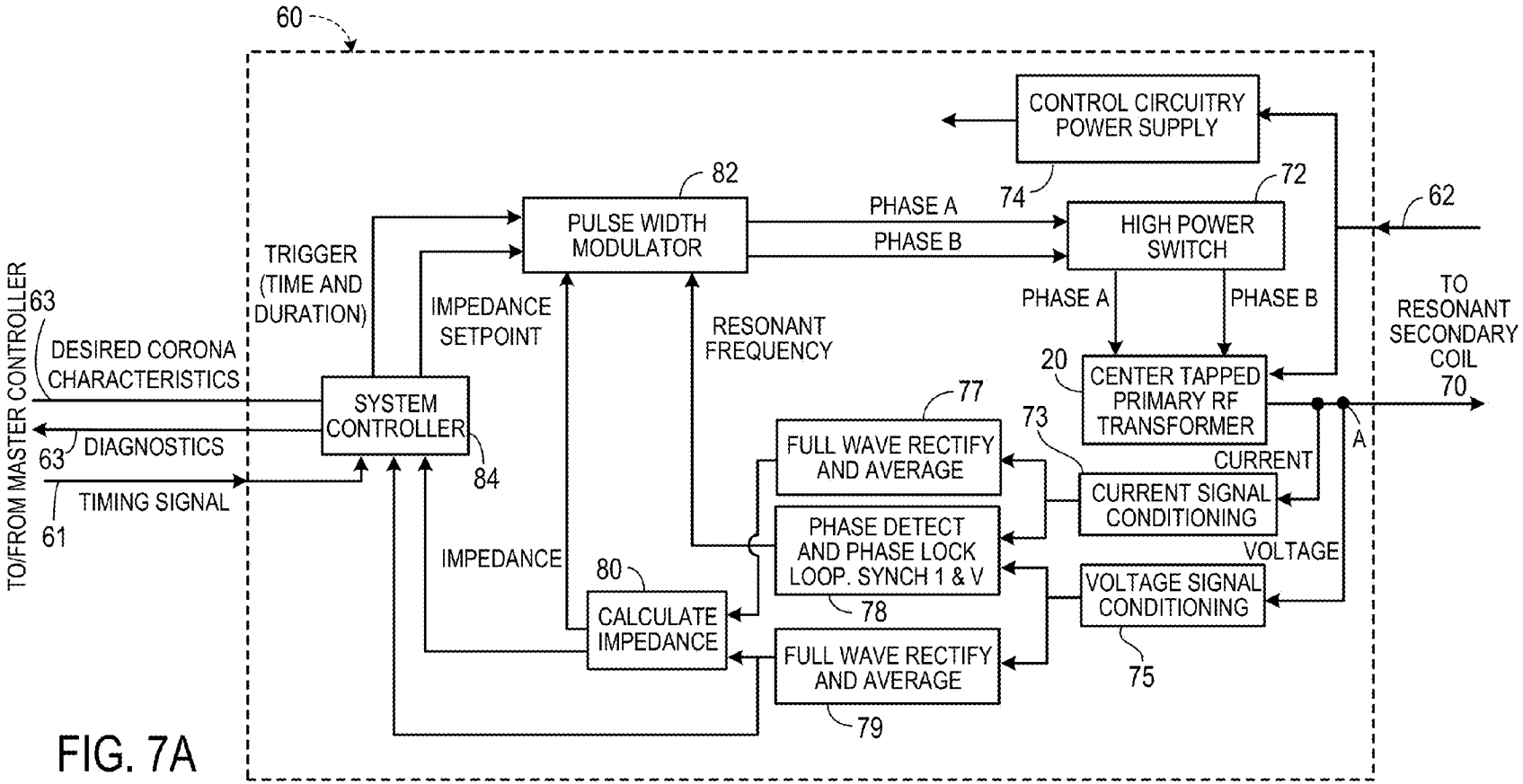
FIG. 7A is a block diagram of the control electronics and primary coil unit of FIG. 3, with an impedance measuring circuit coupled to point A in FIG. 1 or FIG. 2.

FIG. 7A is a functional block diagram of the control electronics and primary coil unit 60. As shown in FIG. 7A, the control electronics and primary coil unit 60 includes a center tapped primary RF transformer 20 which receives via line 62 a voltage of 150 volts, for example, from the DC source. A high power switch 72 is provided to switch the power applied to the transformer 20 between two phases, phase A and phase B at a desired frequency, e.g., the resonant frequency of the high voltage circuit 30 (see FIG. 2). The 150 volt DC source is also connected to a power supply 74 for the control circuitry in the control electronics and primary coil unit 60. The control circuitry power supply 74 can include a step down transformer to reduce the 150 volt DC source down to a level acceptable for control electronics, e.g., 5-12 volts. The output from the transformer 20, depicted at "A" in FIGS. 2 and 7A, is used to power the high voltage circuit 30 housed in the secondary coil unit 70 (see FIG. 3).

The corona discharge ignition system includes an impedance measuring circuit (e.g., 73, 75, 77, 79, and 80 in FIG. 7A) coupled to point A to measure actual impedance of the circuit that provides power to the electrode 40. The current and voltage output from the transformer 20 are detected at point A and conventional signal conditioning is performed at 73 and 75, respectively, e.g., to remove noise from the signals. This signal conditioning may include active, passive or digital, low pass and band-pass filters, for example. The current and voltage signals are then full wave rectified and averaged at 77, 79, respectively. The averaging of the voltage and current, which removes signal noise, may be accomplished with conventional analog or digital circuits. The averaged and rectified current and voltage signals are sent to a divider 80 which calculates the actual impedance by dividing the voltage by the current.

The same or similar circuits may be used to measure baseline impedance directly at the input of the resonant coil 70 or the input to the RF transformer 20 which directly reflects the resonant coil impedance. The baseline impedance is measured at a low voltage (e.g., approximately 10 volts) just prior to firing, so that no corona is formed. The current and voltage signals are also sent to a phase detector and phase locked loop (PLL) 78 which outputs a frequency which is the resonant frequency for the high voltage circuit 30. The PLL determines the resonant frequency by adjusting its output frequency so that the voltage and current are in phase. For series resonant circuits, when excited at resonance, voltage and current are in phase.

Figure 8:
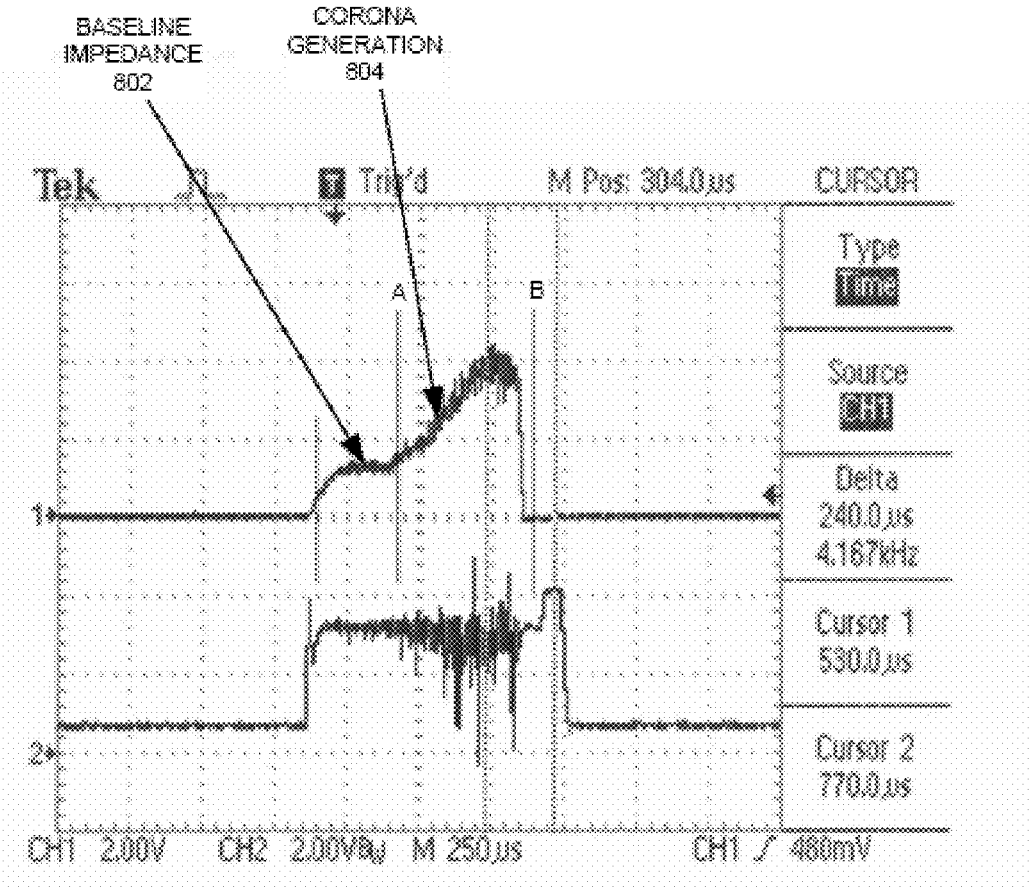
FIG. 8 is a graph of the measurement of impedance at baseline and during corona generation using a corona discharge ignition system.

FIG. 8 shows a graph illustrating the measurement of a baseline impedance 802 just prior to firing. The upper curve is a measurement at the input of the RF step-up transformer 20 (point C in FIG. 2). The lower curve is an analog representation of the resonant frequency. The baseline impedance 802 is measured at 11 volts. The system controller 84 (shown in FIG. 7A) can add the measured baseline impedance 802 to an additional impedance value (e.g., as determined from a mathematical function and/or as looked up in a data structure) to determine the setpoint impedance.

Returning to FIG. 7A, the system controller 84 can control the actual impedance to the setpoint impedance during the electric discharge process, shown as corona generation 804 in FIG. 8, in which a corona is generated 804. The calculated actual impedance from the divider 80 and the resonant frequency from PLL 78 are each sent to a pulse width modulator 82 which outputs two pulse signals, phase A and phase B, each having a calculated duty cycle, to drive the transformer 20. The frequencies of the pulse signals are based on the resonant frequency received from the PLL 78. The duty cycles are based on the impedance received from the divider 80 and also on an impedance setpoint received from a system controller 84. The pulse width modulator 82 adjusts the duty cycles of the two pulse signals to cause the measured impedance from the divider 80 to match the impedance setpoint received from the system controller 84.

Figure 7B:
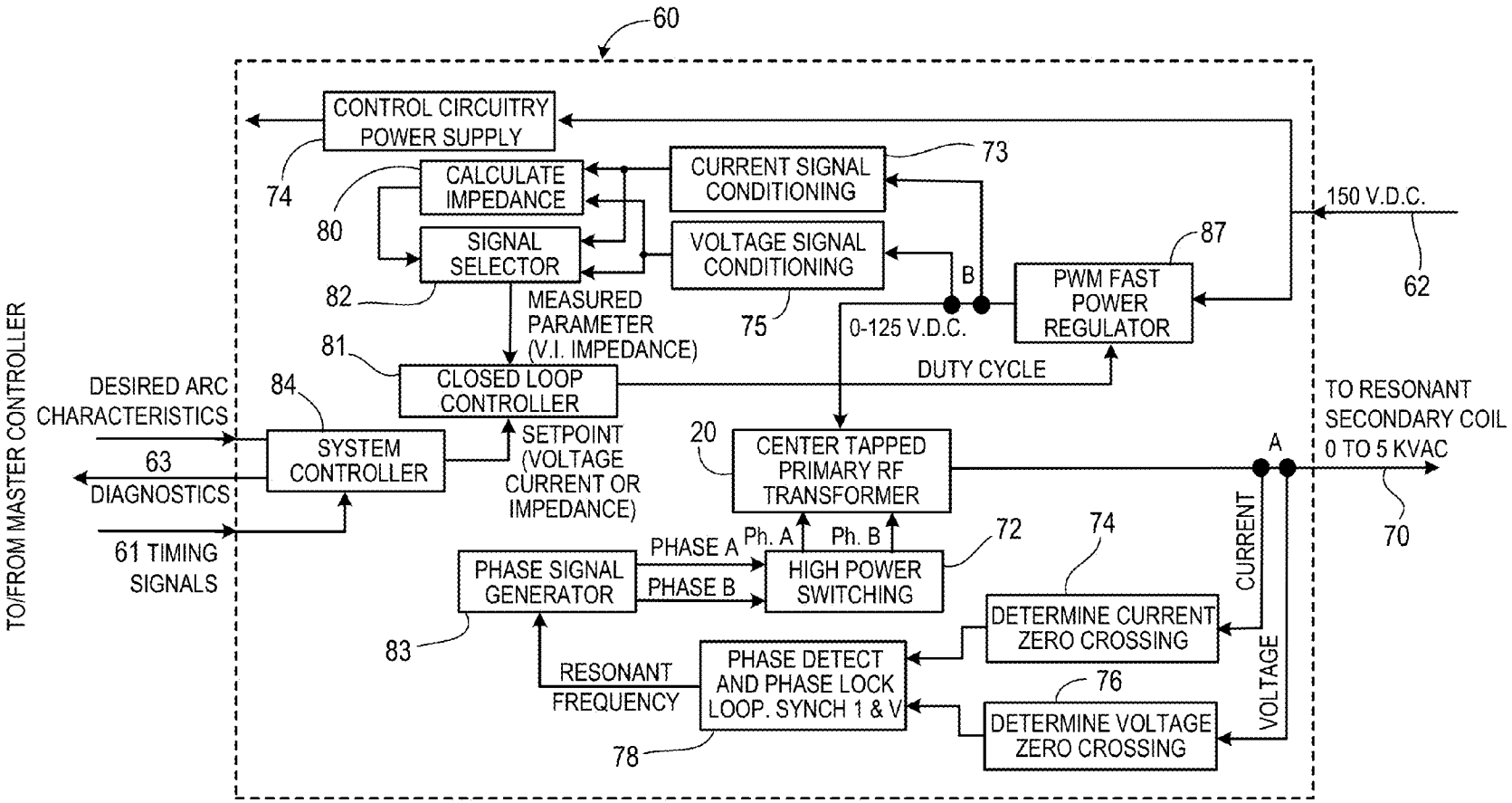
FIG. 7B is a block diagram of the control electronics and primary coil unit of FIG. 3, with an impedance measuring circuit coupled to point B in FIG. 1 or FIG. 2.

FIG. 7B is a functional block diagram of another embodiment of the control electronics and primary coil unit 60. The control electronics and primary coil unit 60 includes a center tapped primary RF transformer 20 which receives a controlled DC voltage between 0 and 125 volts D.C., for example, from a high speed pulse width modulated (PWM) fast power regulator 87. The PWM fast power regulator 87 is powered by a voltage from the D.C. source 62 (e.g., 150 volts). The high power switch 72 switches the power applied to the transformer 20 between two phases, phase A and phase B at a desired frequency, e.g., the resonant frequency of the high voltage circuit 30 (see FIG. 2). The D.C. source 62 is also connected to the power supply 74 for the control circuitry in the control electronics and primary coil unit 60. The control circuitry power supply 74 typically includes a step down transformer to reduce the voltage from the D.C. source to a level acceptable for control electronics, e.g., 5-12 volts. The output from the transformer 20, depicted at "A" in FIGS. 2 and 7B, can be used to power the high voltage circuit 30 housed in the secondary coil unit 70 (see FIG. 3).

In the embodiment shown in FIG. 7B, the corona discharge ignition system includes an impedance measuring circuit (73, 75, 80, and 82 in FIG. 7B) coupled to point C to measure actual impedance and/or baseline impedance of the circuit that provides power to the input of the RF transformer 20. The impedance measurement at point C is equivalent to the impedance at point A divided by the square of the turn ratio of the RF transformer 20. The current and voltage at the supply to the transformer 20 are detected at point C and conventional signal conditioning is performed at 73 and 75, respectively, e.g., to remove noise from the signals. This signal conditioning may include active, passive or digital, low pass and band-pass filters, for example. The averaging of the voltage and current, which removes signal noise, may be accomplished with conventional analog or digital circuits. The averaged current and voltage signals are sent to a divider 80 which calculates the actual impedance by dividing the voltage by the current. The current and voltage signals at A are sent to zero crossing detectors 74 and 76. These signals then go to the phase locked loop (PLL) 78 which outputs the resonant frequency for the high voltage circuit 30. The PLL determines the resonant frequency by adjusting its output frequency so that the voltage and current are in phase. For series resonant circuits, when excited at resonance, voltage and current are in phase.

The calculated impedance as well as the current and voltage signals are sent to a signal selector 82. The signal selector sends the appropriate signal to a closed loop controller 81 depending on the control mode in use. For example, the controller 81 can be configured to control impedance, voltage, or current. The closed loop controller 81 outputs a duty cycle (0 to 100%) to the PWM fast power regulator 87 so that the setpoint parameter and the measured parameter are equal. For example, when the control mode is based on impedance control, the closed loop controller 81 can adjust the duty cycle going to the PWM fast power regulator 87 to cause the measured impedance from the divider 80 to match the impedance setpoint from the system controller 84.

Figure 9:
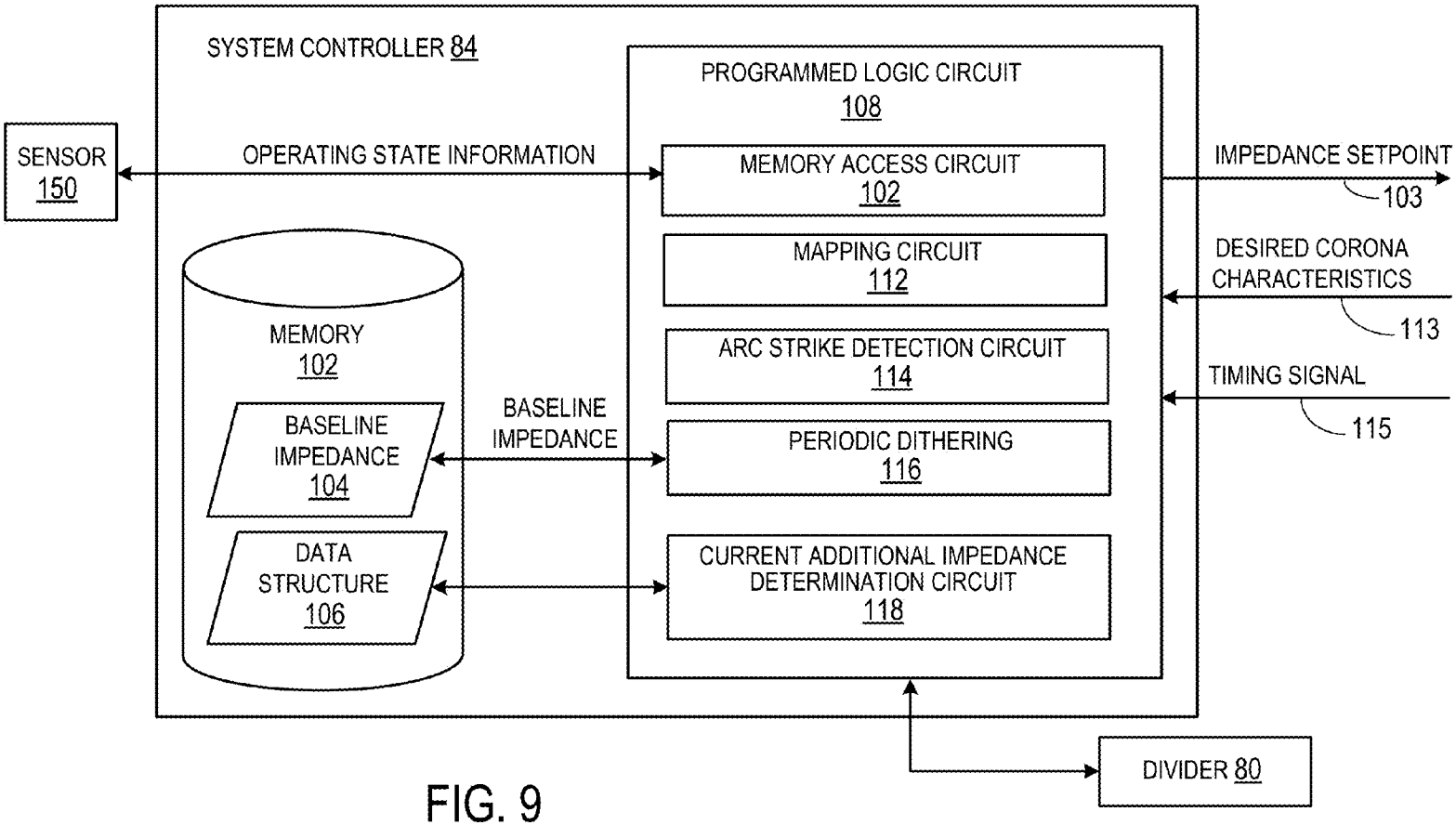
FIG. 9 is a diagram illustrating data flow pertaining to a system controller of a corona discharge ignition system.

Referring to FIG. 9, the system controller 84 includes a memory 102 and a programmed logic circuit 108. As described below, the programmed logic circuit 108 is in communication with the memory 102, a sensor 150 to receive one or more measurements of engine parameters, and the divider 80 to receive the measured impedance (e.g., the measured baseline impedance) and can calculate an impedance setpoint. During use, the programmed logic circuit 108 can determine the impedance setpoint.

The programmed logic circuit 108 can determine the setpoint impedance by adding the baseline impedance to an additional impedance value. The programmed logic circuit 108 can determine an additional impedance value to be used to calculate the setpoint impedance. For example, the programmed logic circuit 108 can determine the additional impedance value in dependence upon optimal combustion characteristics, such as corona size. Additionally or alternatively, the additional impedance can be selected by an operator prior to or during system operation. In certain embodiments, a signal indicating desired corona characteristics (e.g., corona size and intensity) is transmitted to the programmed logic circuit 108 from a master controller of the ICE.

In some embodiments, the programmed logic circuit 108 determines the additional impedance value in dependence upon characteristics of the combustion chamber 50 (e.g., the size of the combustion chamber at a given crank angle). In certain embodiments, the additional impedance value is determined in dependence upon one or more operating states of the engine, including the size of the combustion chamber 50, the piston 54 position in the combustion chamber (e.g., as determined through the angular displacement of a crankshaft coupled to the piston), engine power, cylinder pressure, engine knock, load, throttle position, engine speed, exhaust emissions, fuel efficiency, and so on. In some embodiments, the impedance setpoint is the maximum impedance (e.g., maximum corona size) possible without causing an arc strike.

The system controller 84 can monitor operational conditions in the combustion chamber 50 to facilitate further control. For example, the flame front created in the combustion chamber 50 during the combustion cycle is an electrical conductor. As such, the flame front acts as an electrical shunt on the discharge electrode 40, the electrical shunt varying according to the temperature and size of the flame front. This shunting results in a reduction in the input voltage to the resonant secondary coil 70. The decreased impedance results in a decreased input voltage to radio frequency step-up transformer 20 and to the resonant secondary coil 70.

The shunting of the output of the resonant secondary coil 70 (and the electrode 40 where the corona is formed), with all other variables being held constant, causes the input impedance to the resonant secondary coil 70 to rise to a very high level. However, in some embodiments, the system controller 84 maintains substantially constant impedance by controlling to a constant impedance setpoint. In such constant impedance embodiments, the system controller may respond by lowering the input voltage, as measured at point A, for example, to maintain constant impedance (the ratio of voltage divided by current) at the input side of the resonant secondary coil 70.

The system controller 84 can receive the voltage measurement from voltage signal conditioning unit 75 or rectifier 79 (as shown, for example, in FIG. 7A). Additionally or alternatively, the voltage measurement can be transmitted to the system controller 84 directly from the voltage input at point A in FIG. 7A. The system controller 84 can analyze these voltage measurements and/or analysis of measurements of other variables to determine if the set of measurements is characteristic of flame front shunting in the combustion chamber 50.

As described here, each "measurement" in the set of measurements analyzed by the system controller 84 includes an electrical measurement (e.g., input voltage) and a time when the electrical measurement was taken. As compared to the near instantaneous change in electrical measurements that can occur during an arc strike, the change in electrical measurements that can occur during flame front shunting can be more gradual. The time may be a timestamp, or an integer in a count if the measurements are periodically taken at regular intervals. The programmed logic circuit 108 of the system controller 84 can determine operating conditions in the combustion chamber 50 in dependence upon at least a subset of the set of measurements (e.g., from sensor 150) if the set of measurements are characteristic of flame front shunting in the combustion chamber. Additionally or alternatively, the programmed logic circuit 108 can determine if the set of measurements is characteristic of a misfire condition in the combustion chamber if the set of measurements fail to be characteristic of flame front shunting and/or an arc strike.

The sensor 150 delivers information to the programmed logic circuit 108 indicative of the operating state of the engine, as described above. For example, the sensor 150 may transmit signals indicating the rotational position of a crank shaft, the longitudinal position of a piston in a cylinder, oxygen concentration in the exhaust, knock detection, and/or cylinder pressure. The sensor 150 may transmit information as analog or digital signals utilizing parallel or serial transfer, and may be transmitted as data packets. The signals may be implemented in any of various different forms such as, for example, Controller Area Network ('CAN') bus signals.

The system controller 84 further includes a memory 102 storing a data structure 106 that can associate an operating state with an additional impedance value correlated with a maximum corona size at the operating state such that the setpoint impedance (e.g., the sum of the baseline impedance and the additional impedance) is lower than required for plasma creation and electric arc strike in the combustion chamber. The memory 102 also includes baseline impedance storage 104 such that, for example, a typical baseline impedance value can be stored and compared to an actual baseline impedance for diagnostics. In certain embodiments, the system controller 84 stores the additional impedance in a first memory and the baseline impedance in a second, separate memory.

The programmed logic circuit 108 includes a memory access circuit 110 operatively coupled to the memory 102.

The memory access circuit 110 can access the data structure 106 and return the additional impedance value associated with the operating state. Additionally or alternatively, the memory access circuit 110 can access the data structure 106 and return a baseline impedance value.

The memory access circuit 110 may be implemented completely in hardware, or as software modules executing on one or more embedded processors, or an embodiment combining hardware and software aspects. Memory 102 may be embedded in programmed logic circuit 108 in whole or in part, or may be a separate element operatively coupled to programmed logic circuit 108. Memory 102 may include any form of volatile random access memory ('RAM') and some form or forms of non-volatile computer memory such as a hard disk drive, an optical disk drive, or an electrically erasable programmable read-only memory space (also known as 'EEPROM' or 'Flash' memory), or other forms of non-volatile random access memory ('NVRAM').

Figure 10:
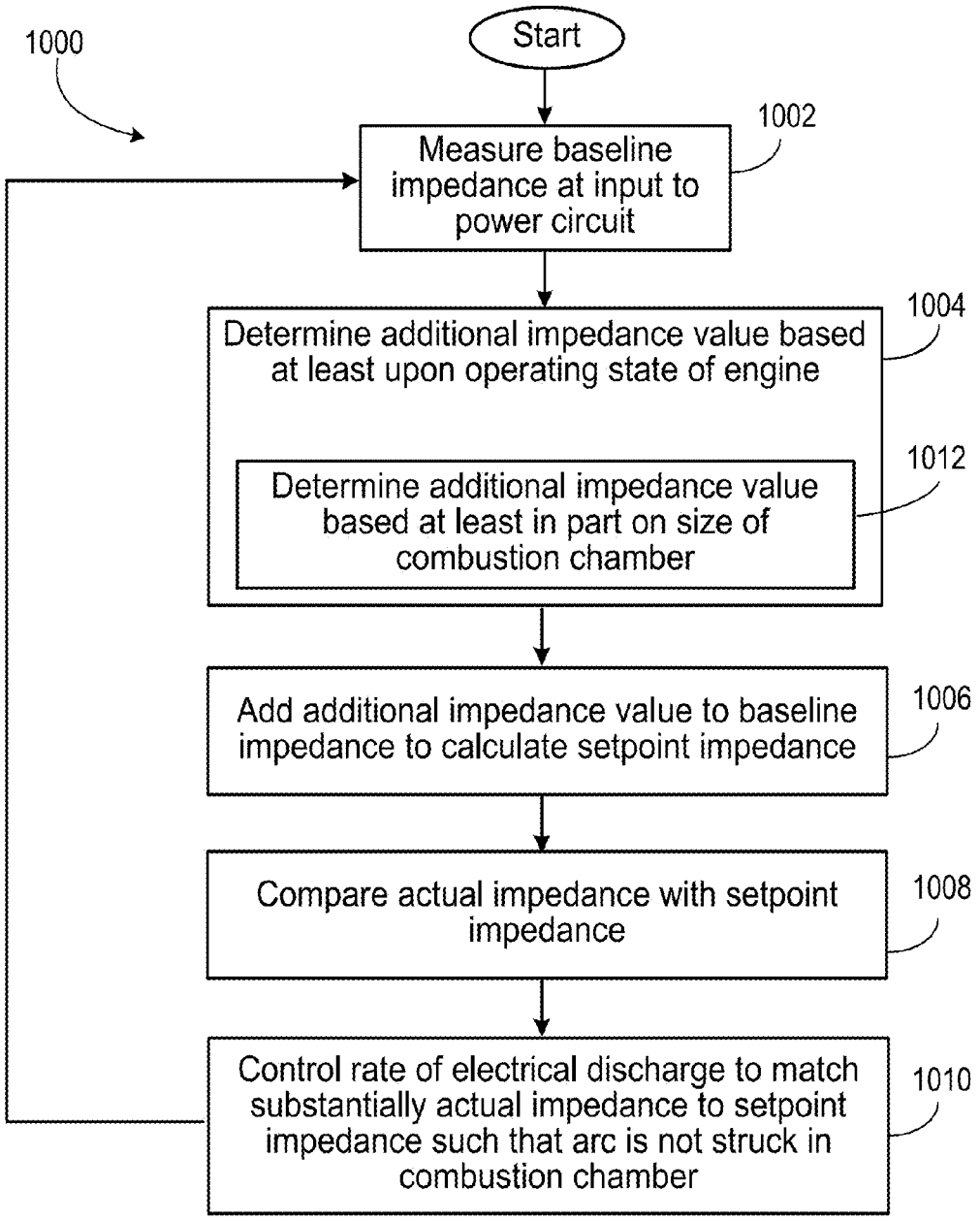
FIG. 10 is a flow chart of a method of calculating a setpoint impedance of a corona discharge ignition system.

FIG. 10 is a flow chart illustrating a method 1000 carried out, for example, by the programmed logic circuit 108 to calculate a setpoint impedance for the corona discharge ignition system. The method includes measuring 1002 a baseline impedance at an input to the high voltage circuit 30 that provides power to the electrode 40; determining 1004 an additional impedance value based at least in part on an operating state of the engine; adding 1006 the additional impedance value to the baseline impedance to calculate a setpoint impedance; comparing 1008 the actual impedance with the setpoint impedance; and controlling 1010 a rate of discharge of electric energy through the electrode 40 to cause the actual impedance to substantially match the setpoint impedance such that a plasma is not created and an electric arc is not struck in the combustion chamber 50. Determining 1004 an additional impedance value in dependence upon an operating state of the engine can include determining 1120 an additional impedance value in dependence upon the size of the combustion chamber.

As described above, determining 1004 the additional impedance value can include determining 1012 the additional impedance value in dependence upon an optimal corona size. In one embodiment, determining 1004 an additional impedance value comprises accessing a data structure, the data structure associating an operating state with an additional impedance value correlated, for example, with a maximum corona size at the operating state such that the setpoint impedance is lower than required for plasma creation and electric arc strike in the combustion chamber; and retrieving from the data structure 106 the additional impedance value associated with the operating state.

Referring again to FIG. 9, the programmed logic circuit 108 may include an arc strike detection circuit 114 configured to detect an electric arc strike. The arc strike detection circuit 114 receives the impedance from the divider 80. The strike detection circuit may detect an arc strike by detecting a decrease in the slope (impedance) of a voltage-current trace. In other embodiments, the arc strike detection circuit 114 may be coupled to input current at point A and may detect an arc strike by detecting a significant and rapid current drop (not shown).

The programmed logic circuit 108 may include a mapping circuit 112 operatively coupled to the memory 102, the arc strike detection circuit 114, and the determination circuit 118. Upon receiving information indicative of an arc strike from the arc strike detection circuit 114, the mapping circuit 112 can subtract a first error margin (e.g., greater than about 0.5% and/or less than about 5%, for example about 1%) from the current additional impedance value to provide an initial impedance value and associate the operating state with the initial impedance value in the data structure 106. In certain embodiments, the mapping circuit 112 is part of a closed loop feedback control system such that, upon detection of an arc strike by the arc strike detection circuit 114, the mapping circuit 112 modifies values in the data structure 106 as operating conditions are achieved during normal operation of the engine. For example, the mapping circuit 112 can dynamically update the data structure 106 with additional impedance values as the engine is operated over time. In some embodiments, the mapping circuit 112 is configured to operate the engine in various operating states during an initial period (e.g., a period after initial start-up of the engine) and populate the data structure 106 as the various operating conditions are achieved during this initial period.

Figure 11:
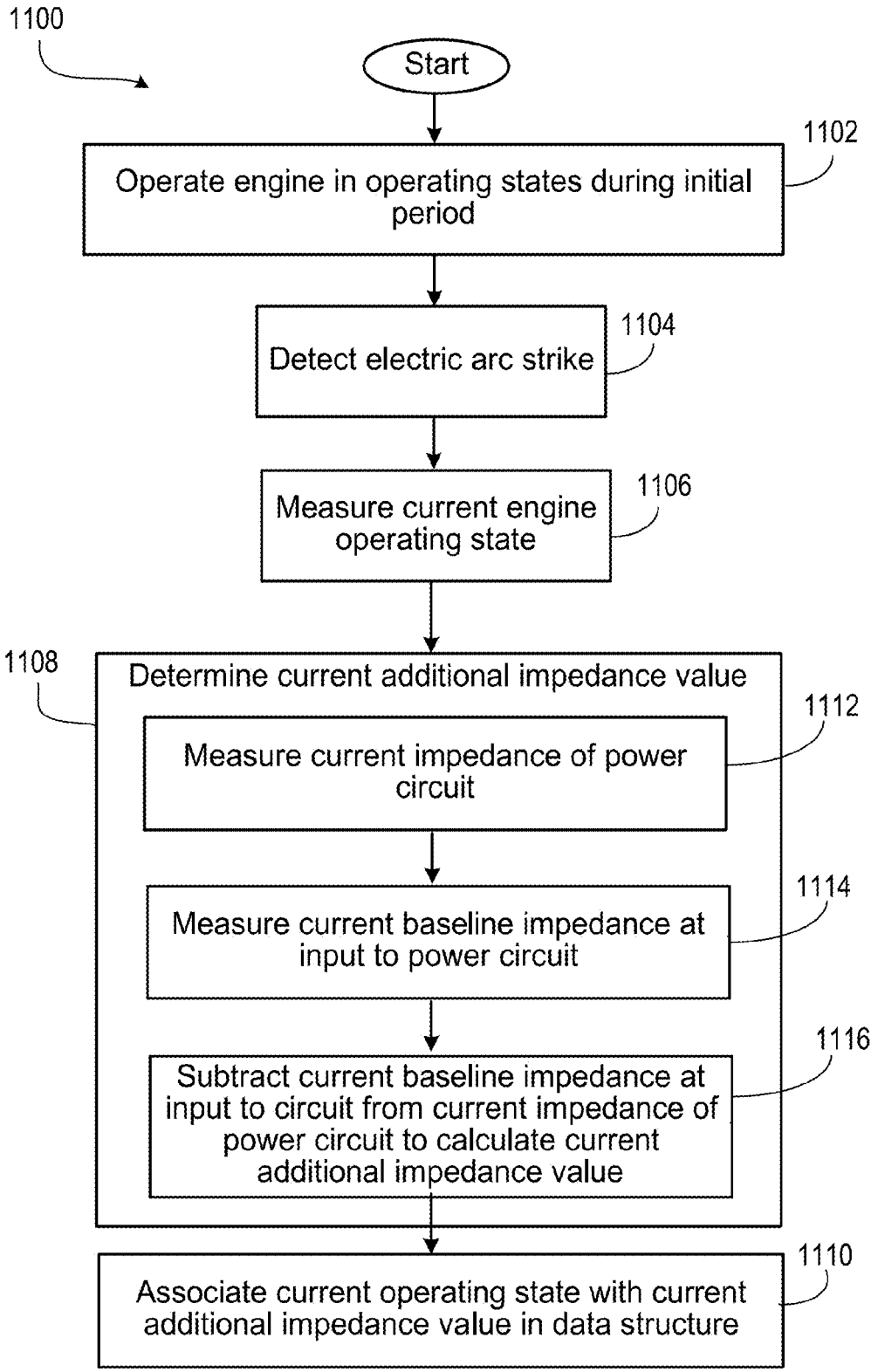
FIG. 11 is a flow chart of a method of initially populating the data structure of a corona discharge ignition system.

Referring now to FIG. 11, a method 1100 of initially populating the data structure 106 can include operating 1102 the engine in various operating states during an initial period; detecting 1104 an electric arc strike; measuring 1106 a current operating state; determining 1108 a current additional impedance value; and associating 1110 the current operating state with the current additional impedance value in the data structure. Determining 1112 the current additional impedance value may be carried out by measuring a current impedance of a the high power circuit 30 that provides power to the electrode 40; measuring 1114 a current baseline impedance at an input to the high power circuit 30 that provides power to the electrode 40; and calculating 1116 the current additional impedance value by subtracting the current baseline impedance at an input to the circuit from the current actual impedance of the high power circuit 30 that provides power to the electrode 40.

The programmed logic circuit 108 may include a periodic dithering circuit 116. The periodic dithering circuit 116 includes a circuit configured to, after an initial period (e.g., the initial period associated with the mapping circuit 112 in some embodiments), iteratively increase the additional impedance value associated (e.g., in the data structure 106) with the operating state, add this increased value to the baseline impedance to create a modified impedance setpoint value for that particular operating state. The iterative increases in the additional impedance value continue until the dithering circuit 116 receives a signal from the arc strike detection circuit 114 indicating an electric arc strike. The periodic dithering circuit 116 is configured to associate the operating state with the modified additional impedance value in a data structure. If, during each iteration, no arc strike signal is received, the dithering circuit 116 associates the operating state with the modified additional impedance value (e.g., by association in the data structure 106).

The periodic dithering circuit 116 further includes a circuit configured to, if arc strike is detected, subtract a second error margin (e.g. greater than about 0.5% and/or less than about 5%, for example about 1%) from the modified additional impedance value to create a new modified additional impedance value and associate the operating state with the new modified additional impedance value (e.g., by association in the data structure 106). Upon receiving a signal from the arc strike detection circuit 114 indicating an electric arc strike, the circuit subtracts the second error margin from the modified additional impedance value to create a new modified additional impedance value and associates the operating state with the new modified additional impedance value (e.g., by association in the data structure 106).

Figure 12:
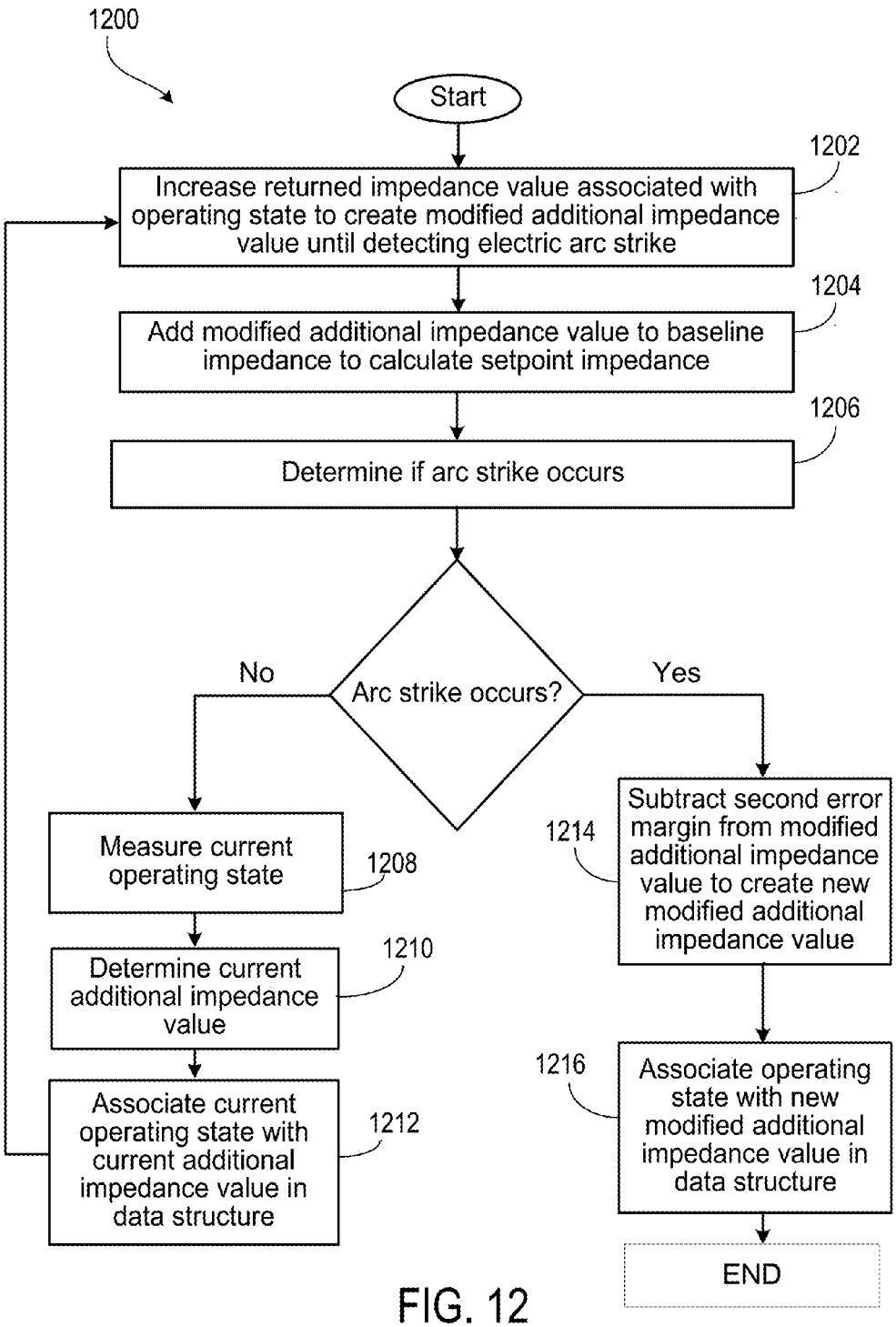
FIG. 12 is a flow chart of a method of gradually updating additional impedance values of a corona discharge ignition system by periodically performing a dithering process.

Referring to FIG. 12 a dithering process 1200 can include, after the initial period, iteratively increasing 1202 the additional impedance value associated with the operating state (e.g., associated in the data structure 106) to create a modified additional impedance value; adding 1204 the modified additional impedance value to the baseline impedance to calculate a setpoint impedance; and determining 1206 if an arc strike occurs. If no arc strike occurs, measuring 1208 a current operating state, determining 1210 a current additional impedance value, and associating 1212 the current operating state with the current additional impedance value (e.g., by association in the data structure 106). If no arc strike is detected, the additional impedance value is again iteratively increased 1202. If arc strike occurs, the dithering process includes subtracting 1214 a second error margin from the modified additional impedance value to create a new modified additional impedance value, and associating 1216 the operating state with the new modified additional impedance value (e.g., by association in the data structure 106).

Figure 15:
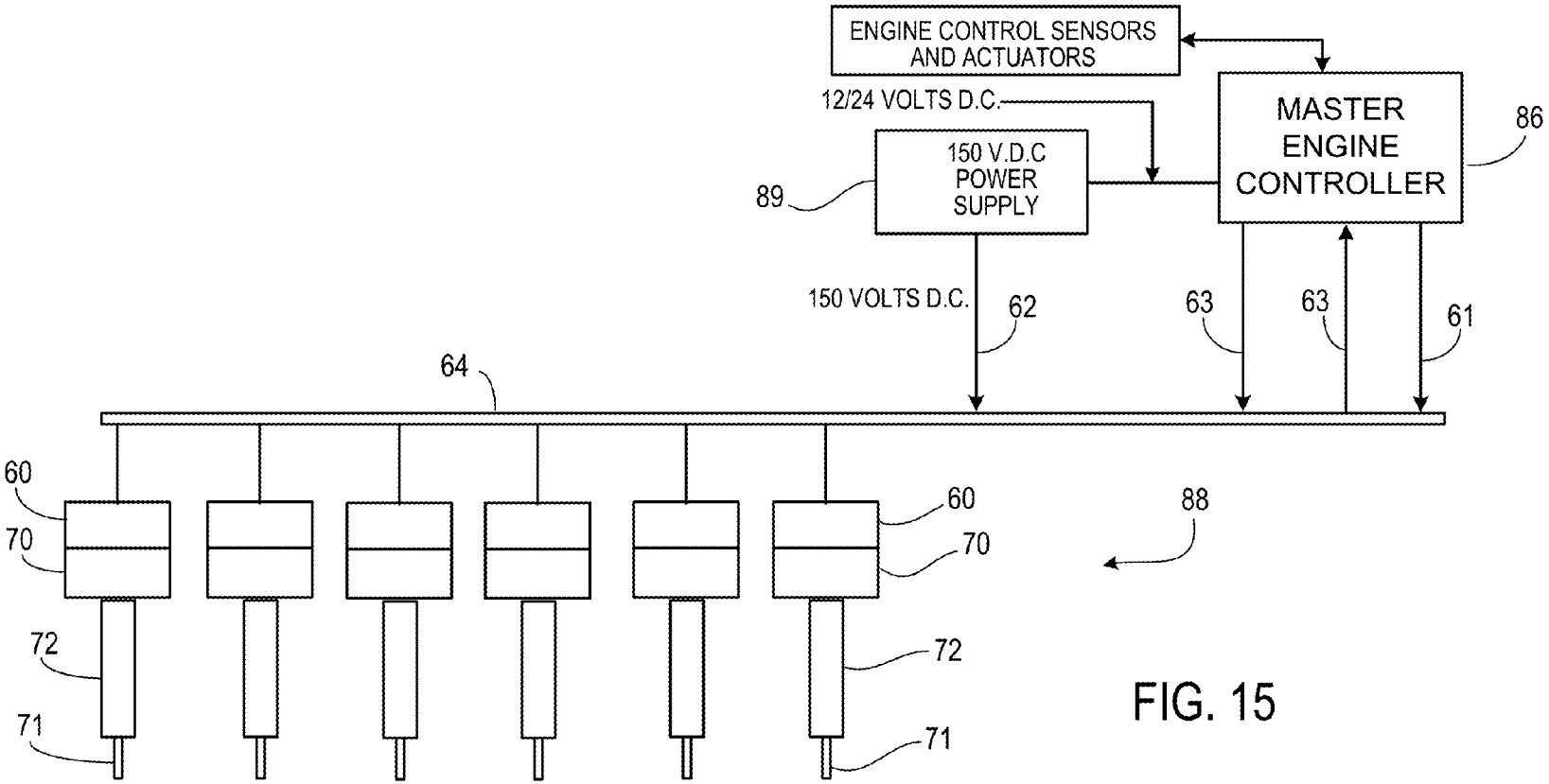
FIG. 15 is a schematic diagram of a master engine controller connected to a number of ignitors of a corona discharge ignition system.

Referring again to FIG. 7A, the system controller 84, in addition to outputting the impedance setpoint, also sends a trigger signal pulse to the pulse width modulator 82. This trigger signal pulse controls the activation timing of the transformer 20 which controls the activation of the high voltage circuit 30 and electrode 40 (shown in FIG. 2). The trigger signal pulse is based on the timing signal 61 received from the master engine controller 86, which is shown in FIG. 15. The timing signal 61 determines when to start the ignition sequence. The system controller 84 receives this timing signal 61 and then sends the appropriate sequence of trigger pulses and impedance setpoint to the pulse width modulator 82. This information tells the pulse width modulator when to fire, how many times to fire, how long to fire, and the impedance setpoint. The desired corona characteristics (e.g., ignition sequence of the pulse width modulator 82 and impedance setpoint) may be hard coded in the system controller 84 or this information can be sent to the system controller 84 through signal 63 from the master engine controller 86. In some embodiments, the system controller 84 sends diagnostics information to the master engine controller 86. Examples of diagnostic information sent from the system controller 84 may include under/over voltage supply, failure to fire as determined from the current and voltage signals, etc.

Figure 13:
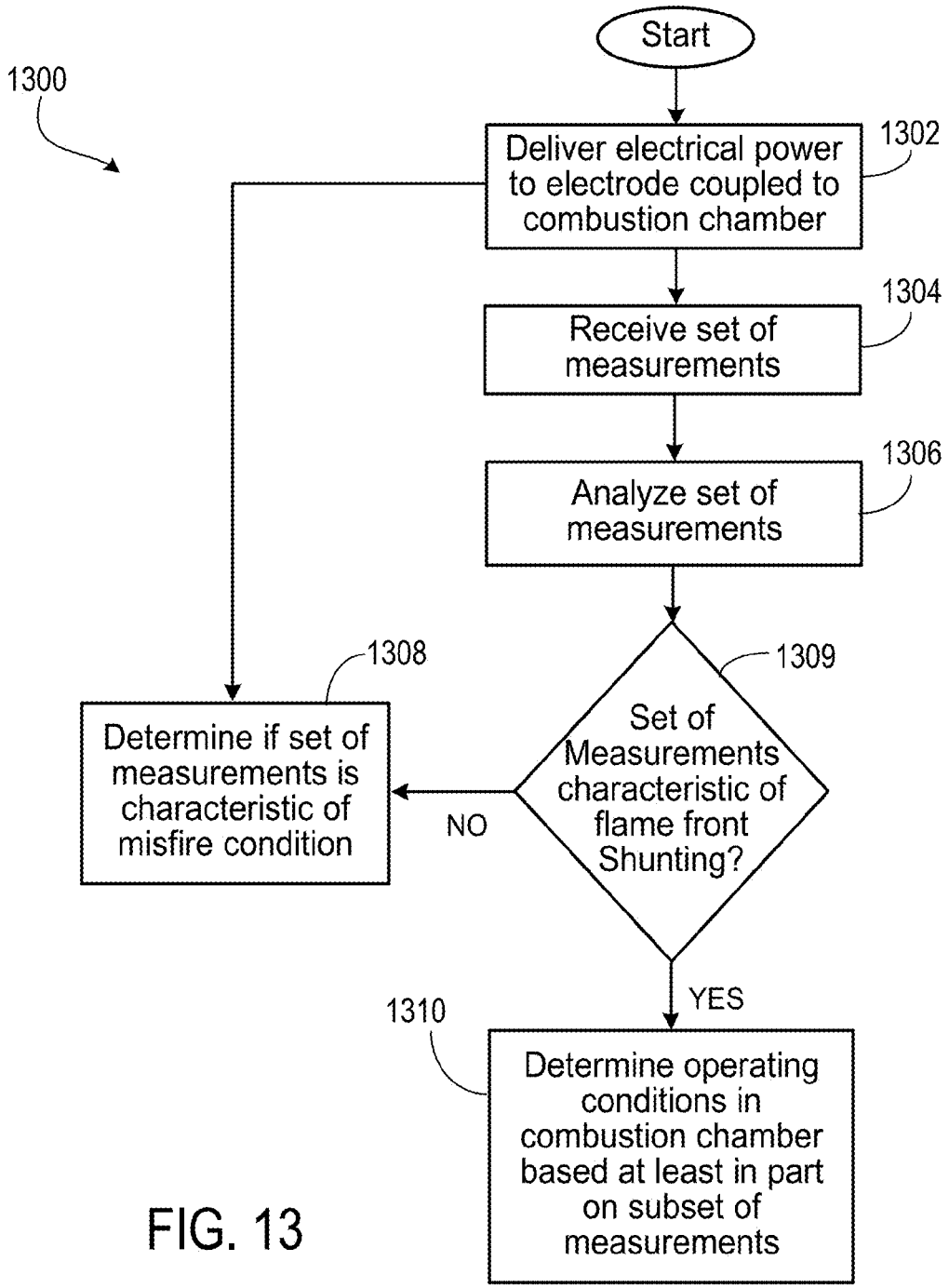
FIG. 13 is a flow chart of a method of controlling combustion in the combustion chamber of an engine including a corona discharge ignition system.

Referring to FIG. 13 a method 1300 of controlling the combustion chamber 50 includes delivering 1302 electrical power to the electrode 40 coupled to the combustion chamber 50; receiving 1304 a set of measurements from the combustion chamber 50; analyzing 1306 the set of measurements to determine 1309 if the set of measurements is characteristic of flame front shunting in the combustion chamber 50.

If the set of measurements is not characteristic of flame front shunting, the method 1300 of controlling the combustion chamber 50 includes determining 1308 if the set of measurements is characteristic of a misfire condition. If the set of measurements is characteristic of flame front shunting, the method includes determining 1310 determining operating conditions in the combustion chamber 50 in dependence upon a subset of the measurements.

Analyzing 1306 the set of measurements may be carried out by calculating changes in the electrical measurements over time; determining a pattern in dependence upon the calculated changes; comparing the pattern with one or more stored measurement profiles; and if the pattern substantially matches (e.g., with allowances for minor deviations) at least one of the stored measurement profiles, returning a positive indication of flame front shunting in the combustion chamber. Calculating the changes in the electrical measurements over time may include treating the measurement and the corresponding time of the measurement as a coordinate pair and finding the slope of one or more segments of the curve created by the set of measurements. Determining a pattern may be carried out by using data fitting, iterative processes or other statistical or mathematical techniques. The measurements may be pre-conditioned by smoothing or pre-processed by excluding measurements falling below a threshold value or outside a specific coordinate space. Measurement profiles may be stored in a profile data structure (e.g., the data structure 106) and accessed by a profile access circuit. In some embodiments, matching measurement patterns with stored profiles with allowances for minor deviations can be accomplished through various mathematic or statistical methods, such individual values being within a standard deviation of an expected value, the use of confidence intervals, curve fitting, and so on, as is well known in the art.

Additionally or alternatively, analyzing 1306 the set of measurements may be carried out by calculating changes in the electrical measurements over time; comparing the calculated changes with one or more threshold values; and upon the calculated changes exceeding the threshold values, returning a positive indication of flame front shunting in the combustion chamber. For example, the threshold values may include the slope of specific subsets of coordinate pairs, specific measurement values, changes in values (e.g., slope, voltage, resonant frequency) according to amount or percentage, or combinations of these.

Figure 14A:
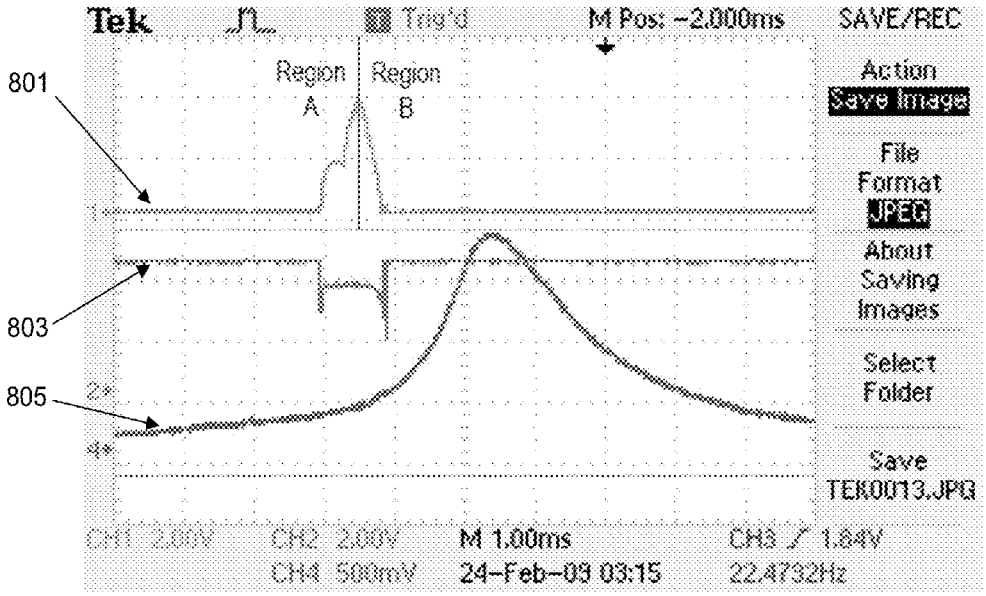
FIGS. 14A-D each depict the input voltage to an RF transformer, frequency, and cylinder pressure of an engine including a corona discharge ignition system and operating at a given fuel-air ratio.

FIGS. 14A-D are graphical representations of voltage profiles representative of various operating conditions in the combustion chamber 50. In each of FIGS. 14A-D, the measurements include the input voltage level 801 of the primary radio frequency transformer 20 and the resonant frequency of the secondary coil 70, the frequency 803, and the cylinder pressure 805 in the ICE. For the conditions depicted in FIG. 14A, the period of time includes the combustion cycle, and the system controller 84 maintains a constant impedance, as described above. FIG. 14A is a graph of electrical measurements over a period of time in the combustion chamber 50 having a stoichiometric mixture of air and fuel (lambda=1). As gas pressure increases during cylinder compression, the voltage required to maintain a constant impedance increases. Upon ignition, the flame front shunts the discharge electrode and causes the voltage required to maintain a constant impedance to decrease. The shunting of the output of the resonant coil 20 causes the input impedance to the resonant coil 20 to rise to a very high level. The input voltage drops, as shown in FIG. 14A, because the system controller is maintaining a constant input impedance and the controller responds to the impedance rise by lowering the voltage to maintain constant input impedance. The combustion using the stoichiometric mixture is relatively fast. The fast combustion results in additional capacitive loading due to the increase in capacitance of the insulating ceramic from temperature effects. This results in a reduction in resonant frequency, as the inductance is fixed.

These conditions result in two regions on the graph. Region A shows the rise in pressure prior to combustion. The voltage rises in this region, giving the curve a generally positive slope. Region B correlates to flame front shunting in the combustion chamber. The voltage drops sharply in this region, giving the curve a comparatively large negative slope.

Figure 14B:
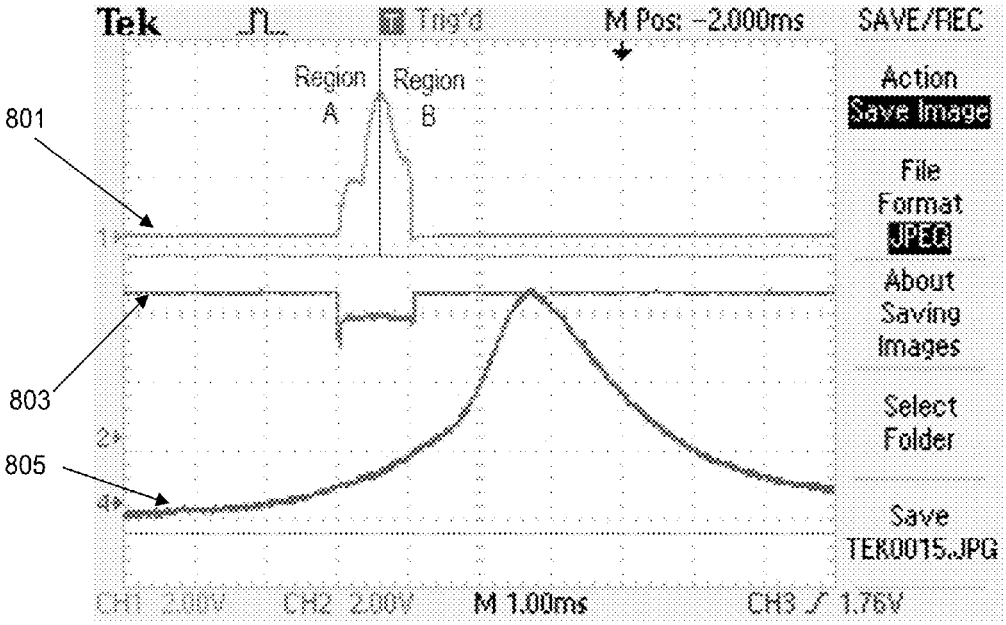

FIG. 14B is a graph of electrical measurements over a period of time in the combustion chamber 50 having a lean mixture of air and fuel at lambda 1.3 (leaner than the mixture corresponding to FIG. 14A). Again, upon ignition, the flame front shunts the discharge electrode 40 and causes the voltage required to maintain a constant impedance to decrease. The combustion using the lean mixture is slower than that with the stoichiometric mixture, such that no additional capacitive loading from temperature effects occurs. Thus, the resonant frequency does not vary significantly. The voltage drops in Region B, but not as sharply as in the case of the stoichiometric mixture (FIG. 14A), giving the curve a comparatively smaller negative slope.

Figure 14C:
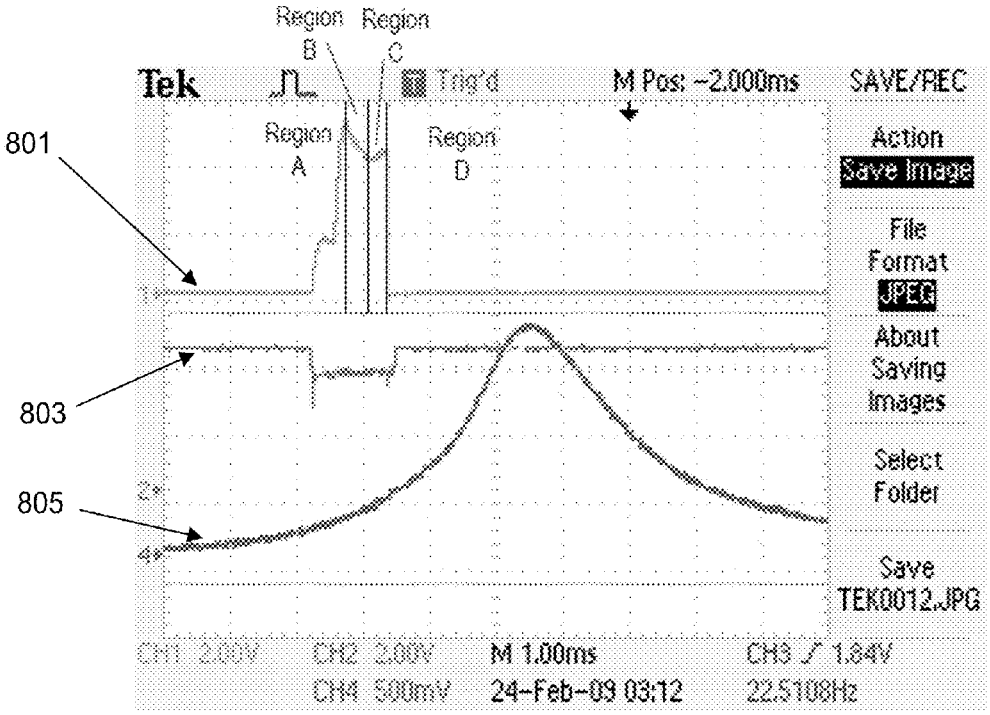

FIG. 14C is a graph of electrical measurements over a period of time in a combustion chamber having a very lean mixture of air and fuel of lambda=1.7. Upon ignition, the flame front shunts the discharge electrode and causes the voltage required to maintain a constant impedance to decrease, as in the examples described above. The combustion using the lean mixture of lambda=1.7 is relatively slow. These conditions result in four regions on the graph. Region A shows the rise in pressure prior to combustion. The voltage rises in this region, giving the curve a generally positive slope. Region B correlates to flame front shunting in the combustion chamber. The voltage drops in this region, giving the curve a negative slope. Region C correlates to the flame front moving away from the electrode, reducing the shunting. The voltage in Region C, therefore, rises, giving the curve in this region a positive slope until combustion is ceased in Region D, and voltage is brought to a minimum.

Figure 14D:
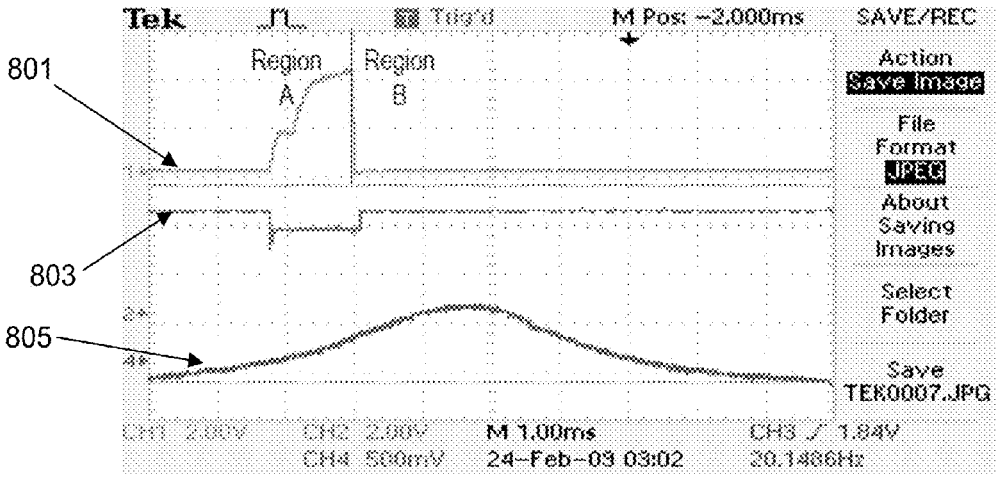

FIG. 14D is a graph of electrical measurements over a period of time in a combustion chamber where there is a misfire, and no combustion takes place. No flame front shunting occurs, so that the voltage continues to rise until the cycle is terminated and voltage is brought to a minimum.

Referring again to FIG. 13, if the set of measurements fail to be characteristic of flame front shunting, the method may determine 1308 if the set of measurements is characteristic of a misfire condition in the combustion chamber 50.

If the set of measurements are characteristic of flame front shunting in the combustion chamber, the method determines 1310 operating conditions in the combustion chamber 50 in dependence upon at least a subset of the set of measurements. In some embodiments, determining operating conditions in the combustion chamber 50 may be carried out without previously determining if the set of measurements are characteristic of flame front shunting. These operating conditions may include flame front burn rate, the in-cylinder ratio of air to fuel, the in-cylinder exhaust gas recirculation (EGR) rate, and optimum ignition duration.

Determining 1310 operating conditions in the combustion chamber 50 may include identifying, in dependence upon the subset of measurements, a duration of corona generation required to develop an optimal flame front. For example, if the electrical measurement is an input voltage of the high power circuit 30, identifying a duration of corona generation required to develop an optimal flame front may be carried out by initiating a timer and stopping the timer when detecting a drop in the input voltage greater than a threshold value; and presenting the elapsed time as the duration of corona generation required to develop an optimal flame front.

Identifying a duration of corona generation required to develop an optimal flame front may also be carried out by detecting a drop in the input voltage greater than a threshold value; and upon detecting a drop in the input voltage greater than a threshold value, ceasing corona generation. The threshold value may be a specific amount or a percentage drop (e.g., 10%).

Additionally or alternatively, determining 1310 operating conditions in the combustion chamber 50 may include determining a flame front burn rate (or combustion rate) by calculating the slope of a subset of measurements. For example, the negative slope of the voltage line (see, e.g., region B in FIG. 14A) after the peak resulting from combustion correlates to the initial flame front burn rate.

In some embodiments, an in-cylinder air-to-fuel ratio is determined in dependence upon the flame front burn rate correlated with combustion quality. Combustion quality may be predetermined in the laboratory or during production with sensors which measure the pressure inside the cylinder (e.g., cylinder pressure transducers) or with other types of sensors in laboratory conditions. These sensors are expensive and are not currently used in production engines. Therefore, an indirect method of estimating the combustion quality based on a correlation with flame front burn rate can be useful, for example, for diagnosing engine operating problems when the engine is in use. In certain embodiments, the input voltage (or impedance) signal can be correlated to the burn rate.

Adding EGR and/or operating with a lean air-fuel ratio can slow down combustion as compared to stoichiometric operation without EGR. By progressively changing the EGR and/or air-fuel ratio, measurements can be mapped for a particular engine to correlate either air-fuel ratio or EGR rate with the amount that the initial combustion rate (determined as described above) slows down. This information can be incorporated into the stored measurement profiles (e.g., a voltage profile). This control system can facilitate an inexpensive, indirect method of determining how well the initial flame front is formed. If no flame front is formed, the misfire can be detected using the measurements as described above. If there is a very fast combustion, the measurements will substantially match a very fast combustion profile. If there is a very slow flame front, then the measurements will substantially match a very slow combustion profile. EGR and/or air-fuel ratios may be similarly mapped.

Correlating the input voltage signal (or impedance) to burn rate may be carried out by calculating the heat release rate (representative of the burn rate) and correlating the cycle-to-cycle heat release to a set of input voltage (or impedance) measurements. This correlation may then be used to fit numerically the profile data to actual measured heat release rate.

Heat release rate may be calculated from instantaneous cylinder pressure and cylinder volume. This may be accomplished by measuring cylinder pressure at 0.1 degree crank angle increments. Because the crank angle directly determines the piston position, the crank angle may be converted to cylinder volume.

The air-fuel ratio may be determined by obtaining a related function in dependence upon the flame front burn rate and combustion quality or by accessing a data structure (e.g., the data structure 106), the data structure associating an air-fuel ratio value with a particular stored measurement profile. An in-cylinder exhaust gas recirculation rate may be obtained in the same manner.

In some embodiments, determining 1308 if the set of measurements is characteristic of a misfire condition in the combustion chamber 50 may be carried out by calculating changes in the electrical measurements over time; determining a pattern in the calculated changes; comparing the pattern with one or more stored misfire measurement profiles; and if the pattern substantially matches at least one of the stored misfire measurement profiles, returning a positive indication of the misfire condition in the combustion chamber. Additionally or alternatively, if the duration of the corona exceeds a maximum value (for example 2 milliseconds) without a determination of flame front shunting, then the ignition is terminated and the particular cylinder is determined to have misfired.

In certain embodiments, determining 1308 if the set of measurements is characteristic of a misfire condition in the combustion chamber 50 may be carried out in a manner similar to determining if the set of measurements is characteristic of flame front shunting in the combustion chamber as described above. For example, determining 1308 if the set of measurements is characteristic of a misfire condition in the combustion chamber may be carried out by calculating changes in the electrical measurements over time; determining a pattern in dependence upon the calculated changes; comparing the pattern with one or more stored misfire measurement profiles; and if the pattern substantially matches at least one of the stored misfire measurement profiles, returning a positive indication of the misfire condition in the combustion chamber. Additionally or alternatively, determining 1308 if the set of measurements is characteristic of a misfire condition in the combustion chamber 50 may be carried out by calculating changes in the electrical measurements over time; comparing the calculated changes with one or more misfire threshold values; and upon the calculated changes exceeding the misfire threshold values, returning a positive indication of the misfire condition in the combustion chamber.

An alert regarding the misfire condition can be triggered if the set of measurements is characteristic of the misfire condition in the combustion chamber. The alert could be an engine light warning, a flag set to indicate service is needed, or an electrical signal to other engine components (e.g., the master engine controller 86 shown in FIG. 15). In some embodiments, the method comprises initiating a corrective action for the misfire condition if the set of measurements is characteristic of the misfire condition in the combustion chamber. For example, the air-fuel ratio may be adjusted, the setpoint impedance may be increased, and so on.

Although elements of the embodiments above are described as part of the system controller 84, in other embodiments, some or all of the elements may be implemented within the master engine controller 86, or as separate controllers or modules operatively coupled to the system controller 84, master engine controller 86, or ignitors 88 (shown in FIG. 15). Measurements may be sent from the control electronics and primary coil unit 60 to the master engine controller 86 as diagnostic information 63.

The corona discharge ignition system may be implemented as a completely hardware embodiment, as software (including firmware or microcode), or as a combination of hardware and software, all of which are referred to herein as "circuits" or "modules". The system controller 84, for example, may be implemented as several hardwired circuits, as design structures implemented on one or more Application Specific Integrated Circuits ('ASICs'), as a design structure core, as one or more software modules executing on any number of embedded processors, or a combination of any of these.

Referring to FIG. 15, the master engine controller 86 is shown with the various timing, diagnostics, and corona characteristics signals. The master engine controller 86 can also in communication with one or more engine control sensors, such as temperature and pressure sensors or a tachometer, and one or more actuators such as fuel injectors or a throttle. Also shown is the DC power supply 89, which may receive a 12/24 volt input and step up the voltage to 150 volts DC, for example with conventional switching power supply techniques.

While the impedance setpoint $I_s$ has been described as being determined by the system controller 84, other embodiments are possible. For example, $I_s$ may be determined by the master engine controller 86. The master engine controller 86 may determine the corona discharge characteristics, including, for example, impedance setpoint, number of discharges per firing sequence, and firing duration, based upon the engine's operating condition, including diagnostic information 63 from the ignition system. A map system correlating the desired corona discharge characteristics with various parameters such as throttle position, engine speed, load, and knock detection may be empirically established for a given engine and built into the master engine controller 86 so that the corona discharge characteristics and, thus, the impedance setpoints are dynamically set according to the map while the engine runs. Additionally or alternatively, the desired corona discharge characteristics may be determined by the master engine controller 86 based upon closed-loop feedback information such as exhaust emissions, engine power, cylinder pressure, etc.

The various signals and DC power are connected to a number of ignitors 88 through a power and logic harness 64. In FIG. 15, six ignitors are shown, one per cylinder. Each ignitor 88 includes a control electronics and primary coil unit 60, a secondary coil unit 70, an electrode housing 72, and a feedthru insulator 71. Each ignitor may have the structure shown in FIG. 3, for example.

The control system may be configured in other ways to control the characteristics and timing of the corona discharge. For example, the power input for the low voltage circuit 10 can be regulated using voltage control or current control techniques. The electric discharge can be regulated by dynamically adjusting the driving frequency of the RF step-up transformer 20 or the resonant frequency of the high voltage circuit 30. Additionally or alternatively, it is also possible to regulate the electric discharge by dynamically changing the characteristics of the high voltage circuit 30.

In some embodiments, the corona discharge is controlled based on the impedance at the output (as opposed to the input) of the high voltage circuit 30. In such embodiments, appropriate components are provided to measure the actual impedance at the output of the high voltage circuit 30 and to select an impedance setpoint 42 (see FIG. 6) to compare with the actual output impedance $I_{a,2}$. The master engine controller 86 may be configured as described above to determine the desired corona characteristics based upon mapping or closed loop feedback control, for example.

The corona discharge ignition system can be used to ignite fuel-air mixtures in ICEs fueled by fuels that include one or more of the following: gasoline, propane, natural gas, hydrogen, and ethanol. Additionally or alternatively the corona discharge ignition system can be used as part of stationary and/or nonstationary ICEs. In some embodiments, the corona discharge ignition system can be used as an ignition assist device in auto ignition-type ICEs such as Diesel engines.

It should be understood that the corona discharge ignition systems disclosed herein are capable of many modifications. Such modifications may include modifications in the engine design, type of measurements taken, the manner in which impedance is controlled, operating conditions determined or monitored, and so on. In various embodiments, control of the electric field in the combustion chamber may be controlled by mapping, by use of a setpoint impedance, and/or through other methods. To the extent such modifications fall within the scope of the appended claims and their equivalents, they are intended to be covered by this disclosure.

What is claimed is:

1. A method of controlling a corona discharge in a combustion chamber without causing an arc strike, the method comprising:

measuring, before corona discharge has begun, a baseline impedance of a circuit in electrical communication with an electrode the electrode arranged to deliver a corona discharge to the combustion chamber;

measuring, during corona discharge, an actual impedance of the circuit;

determining an impedance setpoint based at least in part on the baseline impedance;

comparing the actual impedance to the impedance setpoint; and adjusting the actual impedance based at least in part on the comparison between the actual impedance and the impedance setpoint.

2. The method of claim 1, wherein the baseline impedance of the circuit is measured at a low input voltage, before corona discharge has begun.

3. The method of claim 1, further comprising determining an additional impedance, wherein determining the impedance setpoint comprises adding the additional impedance to the baseline impedance.

4. The method of claim 3, wherein the additional impedance value is based at least in part on an optimal corona size in the combustion chamber.

5. The method of claim 3, wherein determining the additional impedance value comprises accessing a data structure, the data structure associating an operating state with a stored additional impedance value correlated with a maximum corona size at the operating state without plasma creation and electric arc strike in the combustion chamber, and returning the stored additional impedance value associated with the operating state.

6. The method of claim 5, wherein the operating state is one or more of the following: the size of the combustion chamber and a piston position in the combustion chamber.

7. The method of claim 5, further comprising detecting an electric arc strike in the combustion chamber, measuring a current operating state, determining a current additional impedance value, subtracting a first error margin from the current additional impedance value to provide an initial additional impedance value, and associating the current operating state with the initial additional impedance value in the data structure.

8. The method of claim 7, wherein determining the current additional impedance value further comprises:

measuring a current actual impedance of the circuit that provides power to the electrode;

measuring a current baseline impedance at an input to the circuit that provides power to the electrode; and subtracting the current baseline impedance from the current actual impedance to calculate the current additional impedance value.

9. The method of claim 5, further comprising performing a periodic dithering process, the dithering process comprising:

increasing the returned impedance value associated with the operating state to create a modified additional impedance;

adding the modified additional impedance value to the baseline impedance to calculate the setpoint impedance;

determining if arc strike occurs in the combustion chamber;

if no arc strike occurs, measuring a current operating state, determining a current additional impedance value, and associating the current operating state with the current additional impedance value in a data structure; and if arc strike occurs, subtracting a second error margin from the modified additional impedance value to create a new modified additional impedance value, and associating the operating state with the new modified additional impedance value in the data structure.

10. The method of claim 1, further comprising operating the combustion chamber in various operating states during an initial period.

11. The method of claim 1, wherein adjusting actual impedance of the circuit comprises increasing the actual impedance above the impedance setpoint to produce an arc discharge in the combustion chamber if the baseline impedance is above a value indicative of deposit buildup on the electrode or on a portion of a feedthru insulator disposed between the electrode and the combustion chamber.

12. The method of claim 11, further comprising sending an alert to a master engine controller if the baseline impedance does not return below the value indicative of deposit buildup after the circuit has been operated at the increased actual impedance for a threshold period.

13. The method of claim 1, wherein the baseline impedance and the actual impedance are measured at an input to the circuit.

14. A corona discharge control system for controlling a corona discharge in a combustion chamber without causing an arc strike, the control system comprising:

an electrode arranged to deliver a corona discharge to the combustion chamber;

a circuit in electrical communication with the electrode;

a system controller configured to measure, before corona discharge has begun, a baseline impedance of the circuit, measure, during corona discharge, an actual impedance of the circuit, determine an impedance setpoint based at least in part on the baseline impedance, compare the actual impedance to the impedance setpoint, and to adjust the actual impedance based at least in part on the comparison between the actual impedance and the impedance setpoint so as to control the corona discharge.

15. The corona discharge control system of claim 14, wherein the baseline impedance of the circuit is measured at a low input voltage, before corona discharge has begun.

16. The corona discharge control system of claim 14, wherein the system controller is further configured to determine an additional impedance and add the additional impedance to the baseline impedance to determine the impedance setpoint.

17. The corona discharge control system of claim 16, wherein the system controller is configured to determine the additional impedance value based at least in part on an optimal corona size in the combustion chamber.

18. The corona discharge control system of claim 16, wherein the system controller is configured to access a data structure associating an operating state with a stored additional impedance value correlated with a maximum corona size at the operating state without plasma creation and electric arc strike in the combustion chamber, and to return the stored additional impedance value associated with the operating state.

19. The corona discharge control system of claim 18, wherein the operating state is selected from the group consisting of size of the combustion chamber and piston position in the combustion chamber.

20. The corona discharge control system of claim 18, wherein the system controller is further configured to detect an electric arc strike in the combustion chamber, measure a current operating state, determine a current additional impedance value, subtract a first error margin from the current additional impedance value to provide an initial additional impedance value, and associate the current operating state with the initial additional impedance value in the data structure.

21. The corona discharge control system of claim 20, wherein the system controller is further configured to operate the combustion chamber in various operating states during an initial period.

22. The corona discharge control system of claim 20, wherein the configuration of the system controller to determine the current additional impedance value further comprises configuration of the system controller to measure a current actual impedance of the circuit that provides power to the electrode;

measure a current baseline impedance at an input to the circuit that provides power to the electrode; and subtract the current baseline impedance from the current actual impedance to calculate the current additional impedance value.

23. The corona discharge control system of claim 18, wherein the system controller is further configured to perform a periodic dithering process, the configuration of the system controller to perform the dithering process comprising configuration of the system controller to increase the returned impedance value associated with the operating state to create a modified additional impedance, add the modified additional impedance value to the baseline impedance to calculate the setpoint impedance, determine if arc strike occurs in the combustion chamber, if no arc strike occurs, measure a current operating state, determine a current additional impedance value, and associate the current operating state with the current additional impedance value in a data structure, and if arc strike occurs, subtract a second error margin from the modified additional impedance value to create a new modified additional impedance value, and associate the operating state with the new modified additional impedance value in the data structure.

24. The corona discharge control system of claim 14, wherein the system controller is configured to increase the actual impedance above the impedance setpoint to produce an arc discharge in the combustion chamber if the baseline impedance is above a value indicative of deposit buildup on the electrode or on a portion of a feedthru insulator disposed between the electrode and the combustion chamber.

25. The corona discharge control system of claim 24, wherein the system controller is further configured to send an alert if the baseline impedance does not return below the value indicative of deposit buildup after the circuit has been operated at the increased actual impedance for a threshold period.

26. The corona discharge control system of claim 14, wherein the baseline impedance and the actual impedance are measured at an input to the circuit.

* * * * *